US006180328B1

(12) United States Patent
Edwards et al.

(10) Patent No.: US 6,180,328 B1
(45) Date of Patent: Jan. 30, 2001

(54) PHOTOGRAPHIC ELEMENT FOR COLOR IMAGING

(75) Inventors: James L. Edwards, Rochester; William J. Begley, Webster, both of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/473,932

(22) Filed: Dec. 28, 1999

(51) Int. Cl.[7] ..... G03C 1/46
(52) U.S. Cl. ..... 430/503
(58) Field of Search ..... 430/503

(56) References Cited

U.S. PATENT DOCUMENTS

| | | | |
|---|---|---|---|
| 4,705,745 | 11/1987 | Kitchin et al. | 430/505 |
| 4,746,599 | 5/1988 | Deguchi et al. | 430/504 |
| 4,816,378 | 3/1989 | Powers et al. | 430/301 |

FOREIGN PATENT DOCUMENTS

| | | |
|---|---|---|
| 0 825 488 A1 | 2/1998 | (EP) . |
| 0 915 374 A1 | 5/1999 | (EP) . |

*Primary Examiner*—Hoa Van Le

(74) *Attorney, Agent, or Firm*—Arthur E. Kluegel

(57) ABSTRACT

Disclosed is a color photographic element comprising at least five imaging layers including:

a first light sensitive silver halide imaging layer having associated therewith a cyan image dye-forming coupler;

a second light sensitive silver halide imaging layer having associated therewith a magenta image dye-forming coupler;

a third light sensitive silver halide imaging layer having associated therewith a yellow image dye-forming coupler; and a fourth light sensitive silver halide imaging layer having associated therewith a fourth image dye-forming coupler for which the normalized spectral transmission density distribution curve of the dye formed by the fourth image dye-forming coupler upon reaction with color developer has a CIELAB hue angle, $h_{ab}$, from 225 to 310°; and a fifth light sensitive silver halide imaging layer having associated therewith a fifth image dye-forming coupler for which the normalized spectral transmission density distribution curve of the dye formed by the fifth image dye-forming coupler upon reaction with color developer has a CIELAB hue angle, $h_{ab}$, from not less than 355 to not more than 75°. Such an element enables an increase in the color gamut for silver halide imaging.

28 Claims, No Drawings

PHOTOGRAPHIC ELEMENT FOR COLOR IMAGING

FIELD OF THE INVENTION

This invention relates to an improved silver halide photographic element for silver halide imaging systems. More specifically, it relates to such an element comprising at least five separately sensitized light-sensitive silver halide emulsion layers containing, in addition to the three conventional cyan, magenta, and yellow dye-forming layers, a fourth image dye-forming layer comprising a coupler wherein the dye formed by that coupler has a CIELAB $h_{ab}$ hue angle in the range of from not less than 355° to not more than 75°, and a fifth image dye-forming layer comprising a coupler wherein the dye formed by that coupler has a hue angle in the range of from not less than 225° to not more than 310°, which increases the gamut of colors possible.

BACKGROUND OF THE INVENTION

Color gamut is an important feature of color printing and imaging systems. It is a measure of the range of colors that can be produced using a given combination of colorants. It is desirable for the color gamut to be as large as possible. The color gamut of the imaging system is controlled primarily by the absorption characteristics of the set of colorants used to produce the image. Silver halide imaging systems typically employ three colorants, typically including cyan, magenta, and yellow in the conventional subtractive imaging system.

The ability to produce an image containing any particular color is limited by the color gamut of the system and materials used to produce the image. Thus, the range of colors available for image reproduction is limited by the color gamut that the system and materials can produce.

Color gamut is often thought to be maximized by the use of so-called "block dyes". In *The Reproduction of Colour* 4th ed., R. W. G. Hunt, pp 135–144, it has been suggested that the optimum gamut could be obtained with a subtractive three-color system using three theoretical block dyes where the blocks are separated at approximately 490 nm and 580 nm. This proposal is interesting but cannot be implemented for various reasons. In particular, there are no real organic based couplers which produce dyes corresponding to the proposed block dyes.

Variations in the block dye concept are advanced by Clarkson, M., E., and Vickerstaff, T., in "Brightness and Hue of Present-Day Dyes in Relation to Colour Photography," Photo. J. 88b, 26 (1948). Three example spectral shapes are given by Clarkson and Vickerstaff: Block, Trapezoidal, and Triangular. The authors conclude, contrary to the teachings of Hunt, that trapezoidal absorption spectra may be preferred to a vertical sided block dye. Again, dyes having these trapezoidal spectra shapes are theoretical and are not available in practice.

Both commercially available dyes and theoretical dyes were investigated in "The Color Gamut Obtainable by the Combination of Subtractive Color Dyes. Optimum Absorption Bands as Defined by Nonlinear Optimization Technique," J. Imaging Science, 30, 9–12. The author, N. Ohta, deals with the subject of real colorants and notes that the existing curve for a typical cyan dye, as shown in the publication, is the optimum absorption curve for cyan dyes from a gamut standpoint.

McInerney, et al, in U.S. Pat. Nos. 5,679,139; 5,679,140; 5,679,141; and 5,679,142 teach the shape of preferred subtractive dye absorption shapes for use in four color, C,M,Y,K based ink-jet prints.

McInerney, et al, in EP 0825,488 teaches the shape of preferred subtractive cyan dye absorption shape for use in silver halide based color prints.

Kitchin, et al, in U.S. Pat. No. 4,705,745, teach the preparation of a photographic element for preparing half-tone color proofs comprising four separate imaging layers capable of producing cyan, magenta, yellow and black images.

Powers, et al, in U.S. Pat. No. 4,816,378, teach an imaging process for the preparation of color half-tone images that contain cyan, magenta, yellow and, black images. The use of the black dye does little to improve the gamut of color reproduction.

Haraga, et al, in EP 0915374A1, teach a method for improving image clarity by mixing 'invisible' information in the original scene with a color print and reproducing it as an infrared dye, magenta dye or as a mixture of cyan magenta and yellow dyes to achieve improved color tone and realism. The addition of the resulting infrared, magenta, or black dye does little to improve the gamut.

In spite of the foregoing teachings relative to color gamut, the coupler sets which have been employed in silver halide color imaging have not provided the range of gamut desired for modern digital imaging; especially for so-called 'spot colors', or 'HiFi colors'.

It is therefore a problem to be solved by providing a coupler set which provides an increase in color gamut compared to coupler sets comprised of cyan, magenta and yellow dye forming couplers by further incorporating red dye and blue dye forming couplers.

SUMMARY OF THE INVENTION

The invention provides a color photographic element comprising at least five imaging layers including:

a first light sensitive silver halide imaging layer having associated therewith a cyan image dye-forming coupler;

a second light sensitive silver halide imaging layer having associated therewith a magenta image dye-forming coupler;

a third light sensitive silver halide imaging layer having associated therewith a yellow image dye-forming coupler; and a fourth light sensitive silver halide imaging layer having associated therewith a fourth image dye-forming coupler for which the normalized spectral transmission density distribution curve of the dye formed by the fourth image dye-forming coupler upon reaction with color developer has a CIELAB hue angle, $h_{ab}$, from 225 to 310°; and a fifth light sensitive silver halide imaging layer having associated therewith a fifth image dye-forming coupler for which the normalized spectral transmission density distribution curve of the dye formed by the fifth image dye-forming coupler upon reaction with color developer has a CIELAB hue angle, $h_{ab}$, from not less than 355 to not more than 75°.

The invention also includes a process for forming an image in an element of the invention. Such an element provides an increase in the color gamut available for silver halide digital imaging.

DETAILED DESCRIPTION OF THE INVENTION

The invention is summarized in the preceding section. The photographic element of the invention employs subtractive color imaging. In such imaging, a viewable digital print color image is formed by generating a combination of cyan, magenta, yellow, red and blue colorants in proportion to the amounts of exposure of 5 different digitally controlled light sources respectively. The object is to provide a reproduction that is pleasing to the observer but also has the improved capability to specifically reproduce the so-called 'spot colors', Pantone® colors or Hi-Fi colors. Color in the reproduced image is composed of one or a combination of the cyan, magenta and yellow, red, and blue image colorants. The relationship of the original color to the reproduced color is a combination of many factors. It is, however, limited by the color gamut achievable by the multitude of combinations of cyan, magenta, yellow, red and blue colorants used to generate the final image.

In addition to the individual colorant characteristics, it is necessary to have cyan, magenta and yellow, red and blue colorants that have preferred absorption maxima relative to one another and that have absorption band shapes which function together to provide an optimum overall color gamut.

The CIELAB metrics, a*, b*, and L*, when specified in combination, describe the color of an object, whether it be red and blue, green, red and blue (under fixed viewing conditions, etc. The measurement of a*, b*, and L* are well documented and now represent an international standard of color measurement. (The well-known CIE system of color measurement was established by the International Commission on Illumination in 1931 and was further revised in 1971. For a more complete description of color measurement refer to "Principles of Color Technology, 2nd Edition by F. Billmeyer, Jr. and M. Saltzman, published by J. Wiley and Sons, 1981.).

L* is a measure of how light or dark a color is. L*=100 is white. L*=0 is black. The value of L* is a function of the Tristimulus value Y, thus $$L^*=116(Y/Y_n)^{1/3}-16$$

Simply stated, a* is a measure of how green or magenta the color is (since they are color opposites) and b* is a measure of how blue or yellow a color is. From a mathematical perspective, a* and b* are determined as follows:

$$a^*=500\{(X/X_n)^{1/3}-(Y/Y_n)^{1/3}\}$$

$$b^*=200\{(Y/Y_n)^{1/3}-(Z/Z_n)^{1/3}\}$$

where X, Y and Z are the Tristimulus values obtained from the combination of the visible reflectance spectrum of the object, the illuminant source (i.e. 5000° K.) and the standard observer function.

The a* and b* functions determined above may also be used to better define the color of an object. By calculating the arctangent of the ratio of b*/a*, the hue-angle of the specific color can be stated in degrees.

$$h_{ab}=\arctan(b^*/a^*)$$

The nomenclature convention for this definition differs from that of the geographic compass heading where 0° or 360° represents north and the angle increases in a clockwise direction. As defined in colorimetric usage, the 0° hue angle is the geographic equivalent of 90° or east, and hue angle increases in a counterclockwise direction. A hue-angle of 0° is broadly defined as magenta. It's complement, 180°, as green. The hue-angle compass between 0° and 360° then includes and describes the hue of all colors. Hue angle does not define lightness or darkness, which is defined by L*; nor color saturation, C* which is defined as $$C^*=(a^{*2}+b^{*2})^{1/2}$$

While it may be convenient to refer to a color as a specific color, for example, 'red'. In reality, the perception of 'red' may encompass a range of hue-angles. This is also true for any other color. In color photographic systems, it is convenient to form cyan, magenta and yellow dyes as the primary subtractive dye set. Subsequently, to reproduce, for example, 'red', various combinations of yellow and magenta dyes are formed and the combination of these colorants is perceived by the viewer as 'red'. Similarly, to form 'blue', combinations of magenta and cyan dyes are formed and to form 'green', combinations of cyan and yellow dyes are formed.

The possible combinations of cyan, magenta and yellow colorants then limit the color saturation and color gamut of red, green and blue colors that a photographic system can reproduce.

In some systems, such as inkjet or lithographic printing, a $4^{th}$ colorant, K, is added. The $4^{th}$ colorant, is black, and therefore by definition, cannot change the color or hue-angle of a color to which it has been added. The addition of black to a color has two effects: The first to darken the color, thus reducing its L* value and the second to desaturate the color which gives the impression that it is less pure.

As used herein, the color gamut of a colorant set is the sum total of the nine slices of color space represented as the sum of a*×b* areas of 9–L* slices (L*=10, 20, 30, 40, 50, 60, 70, 80, and 90) for the dye set being tested. Color gamut may be obtained through measurement and estimation from a large sample of color patches (very tedious and time-consuming) or, as herein, calculated from the measured and blue absorption characteristics of the individual colorants using the techniques described in J. Photographic Science, 38,163(1990).

The absorption characteristics of a given colorant will vary to some extent with a change in colorant amount (transferred and blue density). This is due to factors such as a measurement flare, colorant-colorant interactions, colorant-receiver interactions, colorant concentration effects, and the presence of color impurities in the media. However, by using characteristic vector analysis (sometimes refereed to as principal component analysis or eigen-vector analysis), one can determine a characteristic absorption curve that is representative of the absorption characteristics of the colorant over the complete wavelength and density ranges of interest. The characteristic vector for each colorant is thus a two-dimensional array of optical transmission density and wavelength. This technique is described by Albert J. Sant in Photographic Science and Engineering, 5(3), May–June 1961 and by J. L. Simonds in the Journal of the Optical Society of America, 53(8), 968–974 (1963).

The characteristic vector for each colorant is a two-dimensional array of optical transmission density and wavelength normalized to a peak height of 1.0. The characteristic vector is obtained by first measuring the reflection spectra of test images comprising patches of varying densities of the colorant, including fully exposed development yielding a Dmax and no exposure (Dmin). The spectral reflection density of the Dmin is then subtracted from the spectral reflection density of each color patch. The resulting Dmin subtracted reflection densities are then converted to transmission density by passing the density data through the Dr/Dt curve as defined by Clapper and Williams, J. Opt. Soc. Am., 43, 595 (1953). Characteristic vector analysis is then used to find one transmission density curve for each colorant which, when scaled in transmission density space, converted to reflection density, and added to the Dmin of the reflection element, gives a best fit to the measured and blue spectral reflectance data. This characteristic vector is used herein to both specify the spectral absorption characteristics of the colorant and to calculate the color gamut of each imaging system employing the colorant.

Imaging couplers are nominally termed yellow, magenta and cyan if the spectra of their dyes generally absorb in the ranges of 400–500 mn, 500–600 nm, and 600–700 nm, respectively. The image dye-forming couplers in a given color record, typically comprised of one or more light sensitive silver halide emulsion layers, produce image dyes of similar spectral absorption (e.g $\lambda_{max}$±20 nm). Image dye-forming couplers are sufficient in type and laydown, considering all of the layers of a given color record, to provide a Dmax of at least 1.0. They may thereby be distinguished from functional PUG (photographically useful group) releasing couplers as known in the art, which form a very small portion of the resulting image dye. Thus, after coupling with oxidized developer, the image dye-forming couplers form a predominant portion of the image dye of a particular color record at maximum density. An imaging layer or layer(s) is a layer that is sensitized to light of a particular color range, suitably at least 30 nm apart from such layers sensitized to other color ranges. The absorption curve shape of a colorant is a function of many factors and is not merely a result of the selection of a particular colorant compound. The couplers conventionally employed in silver halide photography form dyes that include yellow ($h_{ab}$= 80–100°); cyan ($h_{ab}$=200–220°); magenta ($h_{ab}$=320–350°). Further the spectral curve may represent the composite absorbance of two or more compounds. For example, if one particular compound provides the desired spectral curve, the addition of further compounds of the same color may provide a composite curve, which remains within the desired range. Thus, when two or more dyes of a particular color are employed, the spectral curve for the "magenta", "yellow", "blue", "red", or "cyan" colorant, for purposes of this invention, means the composite curve obtained from these two or more colorants.

Besides the chemical constitution of the dyes, the spectral curve of a given dye can be affected by other system components (solvents, surfactants, etc.). These parameters are selected to provide the desired spectral curve.

As noted above, the red coupler forms a dye that has a hue-angle, $h_{ab}$, of not less than 355° and not more than 75°, and the blue coupler forms a dye that has a hue-angle from 225 to 310°. The dyes are formed upon reaction of the coupler with a suitable developing agent such as a p-phenylenediamine color developing agent. Suitably the agent is CD-3 as disclosed for use in the RA-4 process of Eastman Kodak Company as described in the British Journal of Photography Annual of 1988, pp 198–199.

The hue angle of the 'red' dye is from not less than 355° to not more than 75°, suitably from 5–75°, and preferably from 15–75°, and in this five member coupler combination, desirably from 25–45°.

Examples of 'red' dyes useful in the invention are:

IR-1

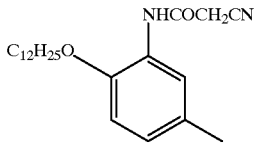

IR-2

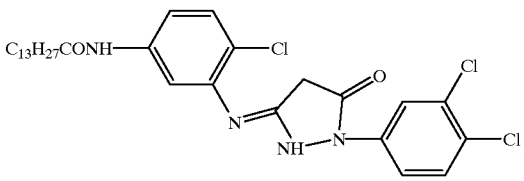

IR-3

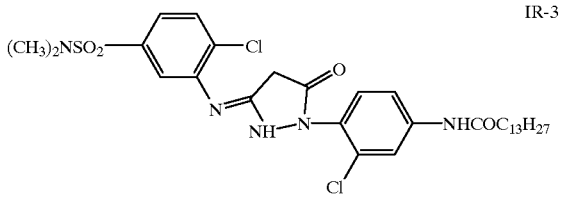

IR-4

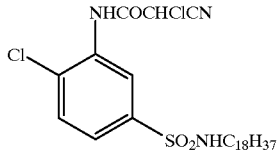

IR-5

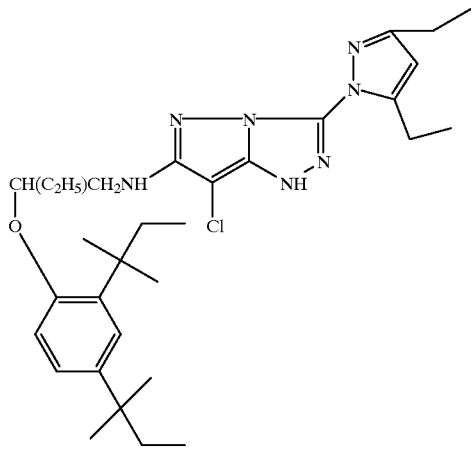

IR-6

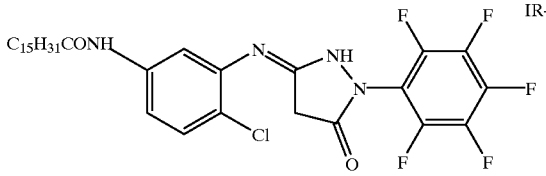

-continued
IR-7
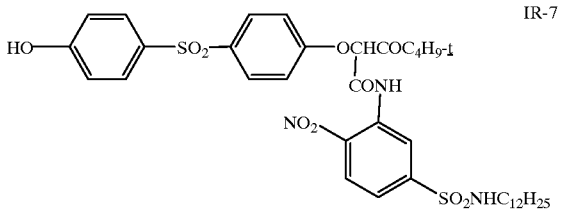
IR-8
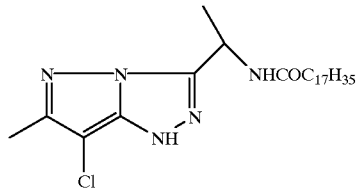
IR-9
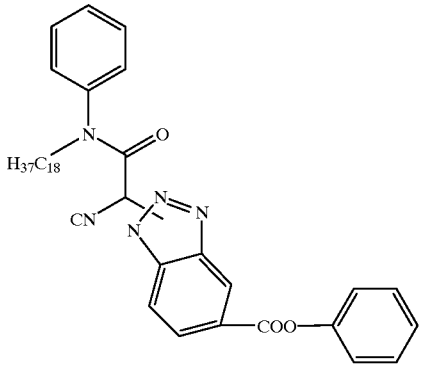
The hue angle of the 'blue' dye is from 225 to 310°, suitably from 228–305°, and preferably from 230–290°. Examples of 'blue' dyes useful in the invention are:
IB-1
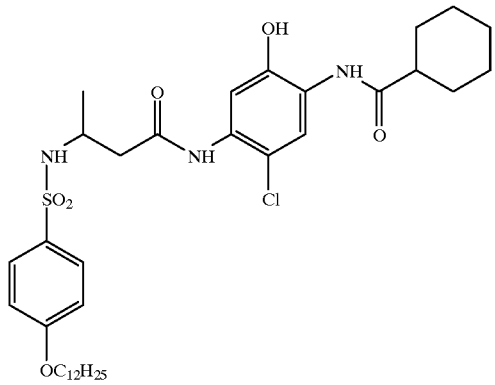
-continued
IB-2
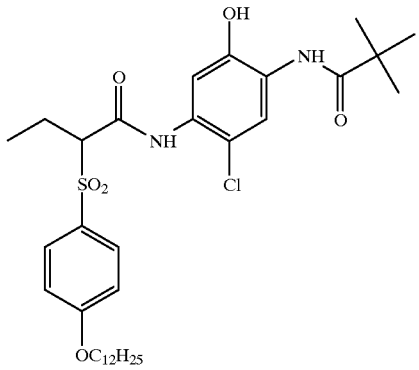
IB-3
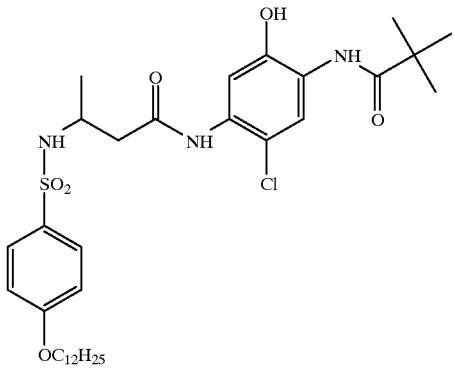
IB-4
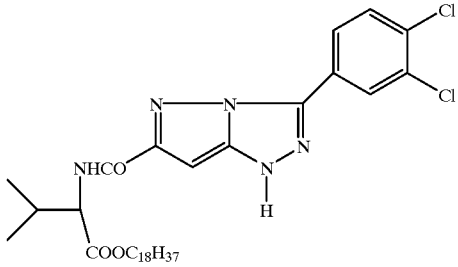
IB-5
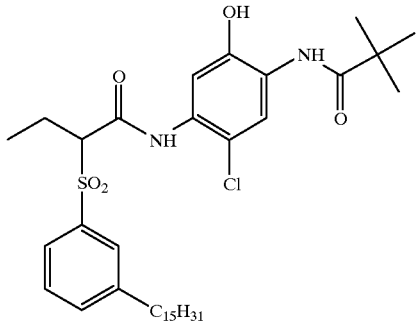

-continued

IB-6

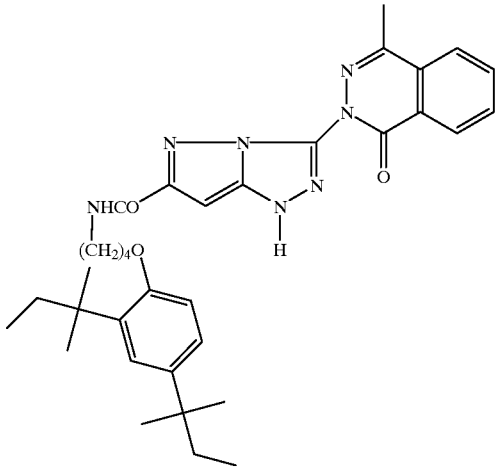

Since the effect of the 'red' and 'blue' dye-forming couplers of the invention is optical rather than chemical, the invention is not limited to a particular compound or class of compounds. Further, more than one coupler of a particular color may be employed in combination which together produce a composite density curve which may satisfy the requirements of the invention.

Cyan Image Couplers

The cyan coupler forms a dye that generally absorbs in the range between 600 nm and 700 nm. The dye is formed upon reaction with a suitable developing agent such as p-phenylenediamine color-developing agent. Suitably the agent is CD-3, 4-amino-3-methyl-N-ethyl-N-(2-methanesulfonamido-ethyl)aniline sesquisulfate hydrate, as disclosed for use in the RA-4 process of Eastman Kodak Company as described in the British Journal of Photography Annual of 1988, Pp 198–199.

An example of a cyan dye forming coupler useful in the invention is one having Formula (I):

(I)

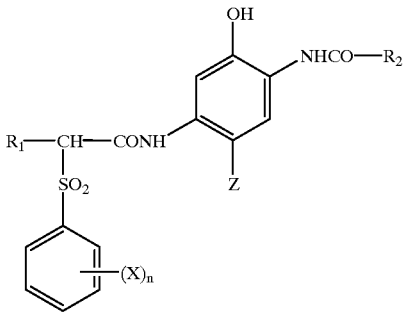

wherein $R_1$ represents hydrogen or an alkyl group;

$R_2$ represents an alkyl group or an aryl group;

n represents 1, 2, or 3;

each X is a substituent; and

Z represents a hydrogen atom or a group which can be split off by the reaction of the coupler with an oxidized color developing agent.

Coupler (I) is a 2,5-diacylaminophenol cyan coupler in which the 5-acylamino moiety is an amide of a carboxylic acid which is substituted in the alpha position by a particular sulfone (—$SO_2$—) group. The sulfone moiety is an arylsulfone. In addition, the 2-acylamino moiety must be an amide (—NHCO—) of a carboxylic acid, and cannot be a ureido (—NHCONH—) group. The result of this unique combination of sulfone-containing amide group at the 5-position and amide group at the 2-position is a class of cyan dye-forming couplers which form H-aggregated image dyes having very sharp-cutting dye hues on the short wavelength side of the absorption curves and absorption maxima (λmax) generally in the range of 620–645 nanometers, which is ideally suited for producing excellent color reproduction and high color saturation in color photographic papers.

Referring to formula (I), $R_1$ represents hydrogen or an alkyl group including linear or branched cyclic or acyclic alkyl group of 1 to 10 carbon atoms, suitably a methyl, ethyl, n-propyl, isopropyl or butyl group, and most suitably an ethyl group.

$R_2$ represents an aryl group or an alkyl group such as a perfluoroalkyl group. Such alkyl groups typically have 1 to 20 carbon atoms, usually 1 to 4 carbon atoms, and include groups such as methyl, propyl and dodecyl,; a perfluoroalkyl group having 1 to 20 carbon atoms, typically 3 to 8 carbon atoms, such as trifluoromethyl or perfluorotetradecyl, heptafluoropropyl or heptadecylfluorooctyl; a substituted or unsubstituted aryl group typically having 6 to 30 carbon atoms, which may be substituted by, for example, 1 to 4 halogen atoms, a cyano group, a carbonyl group, a carbonamido group, a sulfonamido group, a carboxy group, a sulfo group, an alkyl group, an aryl group, an alkoxy group, an aryloxy group, an alkylthio group, an arylthio group, an alkylsulfonyl group or an arylsulfonyl group. Suitably, $R_2$ represents a heptafluoropropyl group, a 4-chlorophenyl group, a 3,4-dichlorophenyl group, a 4-cyanophenyl group, a 3-chloro-4-cyanophenyl group, a pentafluorophenyl group, a 4-carbonamidophenyl group, a 4-sulfonamidophenyl group, or an alkylsulfonylphenyl group.

Examples of a suitable X substituent is one located at a position of the phenyl ring meta or para to the sulfonyl group and is independently selected from the group consisting of alkyl, alkenyl, alkoxy, aryloxy, acyloxy, acylamino, sulfonyloxy, sulfamoylamino, sulfonamido, ureido, oxycarbonyl, oxycarbonylamino, and carbamoyl groups In formula (I), each X is preferably located at the meta or para position of the phenyl ring, and each independently represents a linear or branched, saturated or unsaturated alkyl or alkenyl group such as methyl, t-butyl, dodecyl, pentadecyl or octadecyl; an alkoxy group such as methoxy, t-butoxy or tetradecyloxy; an aryloxy group such as phenoxy, 4-t-butylphenoxy or 4-dodecylphenoxy; an alkyl or aryl acyloxy group such as acetoxy or dodecanoyloxy; an alkyl or aryl acylamino group such as acetamido, benzamido, or hexadecanamido; an alkyl or aryl sulfonyloxy group such as methylsulfonyloxy, dodecylsulfonyloxy, or 4-methylphenylsulfonyloxy; an alkyl or aryl sulfamoylamino group such as N-butylsulfamoylamino, or N-4-t-butylphenylsulfamoylamino; an alkyl or aryl sulfonamido group such a methanesulfonamido, 4-chlorophenylsulfonamido or hexadecanesulfonamido; a ureido group such as methylureido or phenylureido; an alkoxycarbonyl or aryloxycarbonylamino group such as methoxycarbonylamino or phenoxycarbonylamo; a carbamoyl group such as N-butylcarbamoyl or N-methyl-N-dodecylcarbamoyl; or a perfluoroalkyl group such as trifluoromethyl or heptafluoropropyl. Suitably X represents the above groups having 1 to 30 carbon atoms, more preferably 8 to 20 linear carbon atoms. Most typically, X represents a linear alkyl or alkoxy group of 12 to 18 carbon atoms such as dodecyl, dodecyloxy, pentadecyl or octadecyl.

"n" represents 1, 2, or 3; if n is 2 or 3, then the substituents X may be the same or different.

Z represents a hydrogen atom or a group which can be split off by the reaction of the coupler with an oxidized color developing agent, known in the photographic art as a "coupling-off group". The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio, and arylazo. These coupling-off groups are described in the art, for example, in U.S. Pat. Nos. 2,455,169, 3,227,551, 3,432,521, 3,467,563, 3,617,291, 3,880,661, 4,052,212, and 4,134,766; and in U.K. Patent Nos. and published applications 1,466,728, 1,531,927, 1,533,039, 2,066,755A, and 2,017,704A, the disclosures of which are incorporated herein by reference. Halogen, alkoxy and aryloxy groups are most suitable.

Examples of specific coupling-off groups are —Cl, —F, —Br, —SCN,—$OCH_3$, —$OC_6H_5$, —$OCH_2C(=O)NHCH_2CH_2OH$, —$OCH_2C(O)NHCH_2CH_2OCH_3$, —$OCH_2C(O)NHCH_2CH_2OC(=O)OCH_3$, —$P(=O)(OC_2H_5)_2$, —$SCH_2CH_2COOH$,

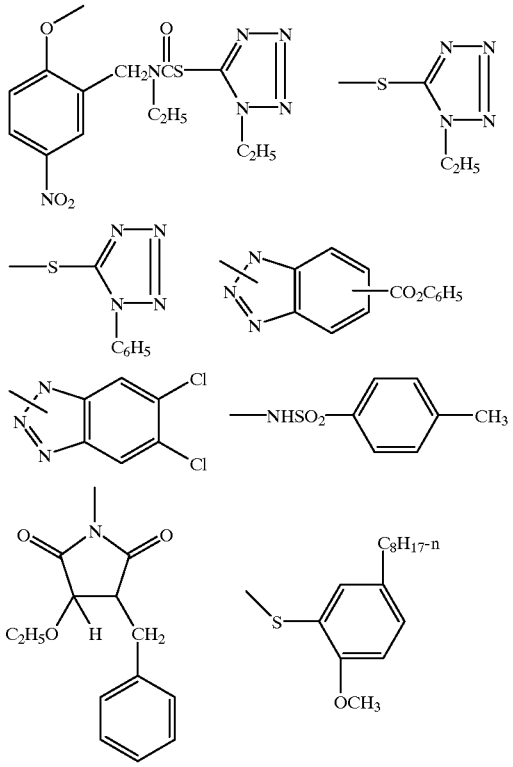

-continued

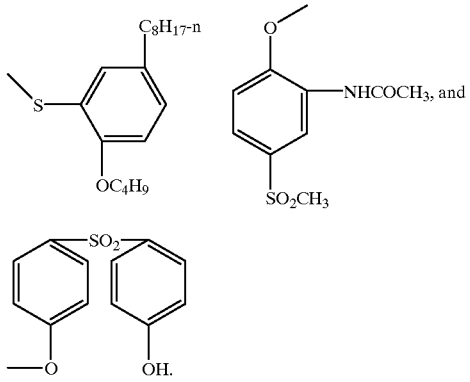

Typically, the coupling-off group is a chlorine atom.

It is essential that the substituent groups of the coupler be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus the combination of substituent groups in formula (I) are suitably chosen to meet these criteria. To be effective, the ballast must contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group. Therefore, in these embodiments the ballast would be primarily located as part of groups $R_2$, X, and Z. Furthermore, even if the coupling-off group Z contains a ballast it is often necessary to ballast the other substituents as well, since Z is eliminated from the molecule upon coupling; thus, the ballast is most advantageously provided as part of groups $R_2$ and X.

The following examples illustrate cyan couplers useful in the invention. It is not to be construed that the present invention is limited to these examples.

C-1

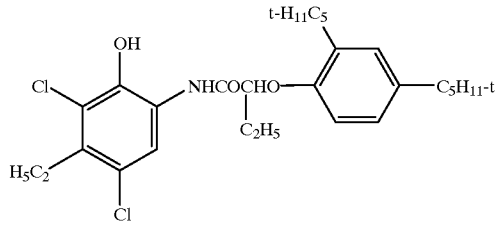

-continued
C-2
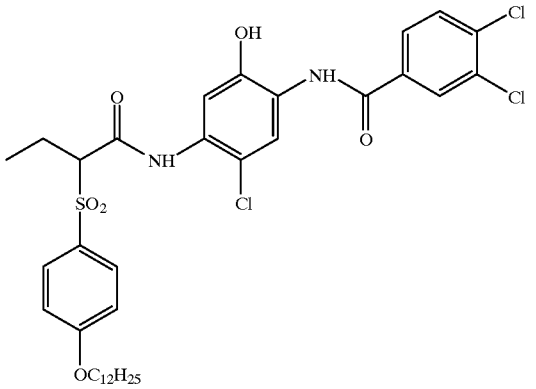
C-3
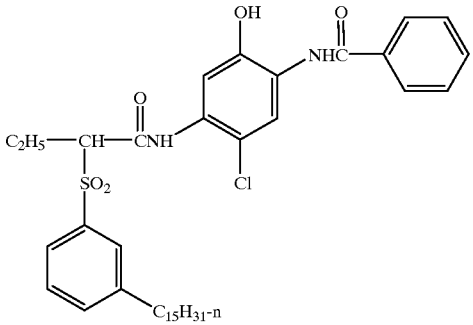
C-4
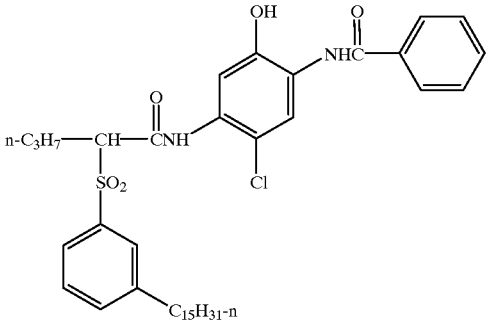
C-5
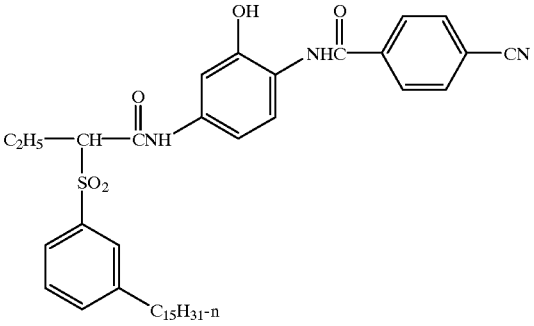
-continued
C-6
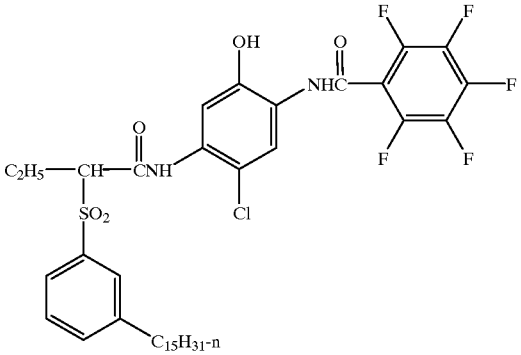
C-7
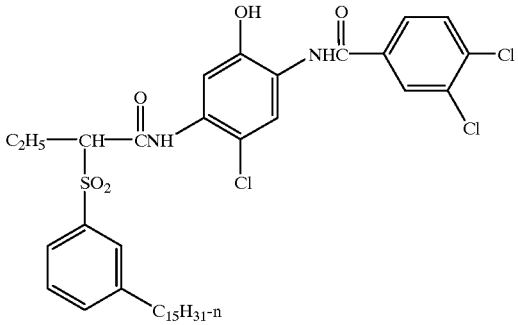
C-8
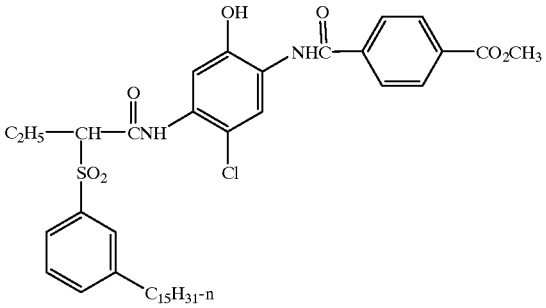
C-9
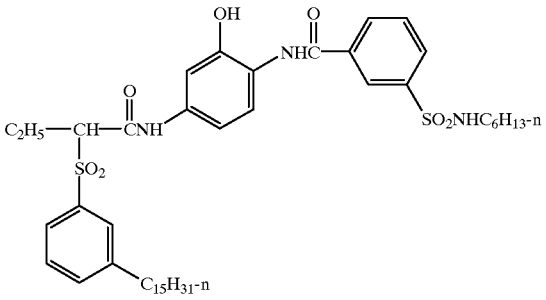

-continued
C-10
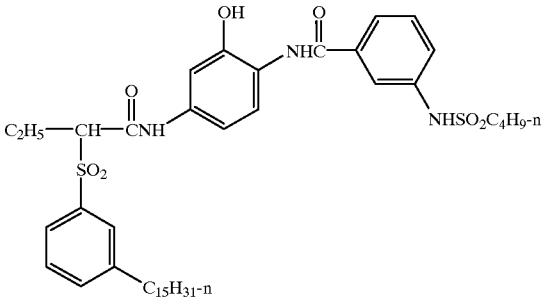
C-11
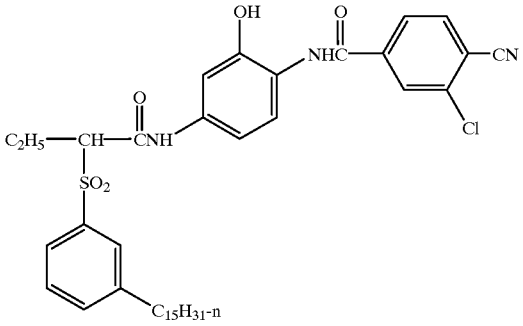
C-12
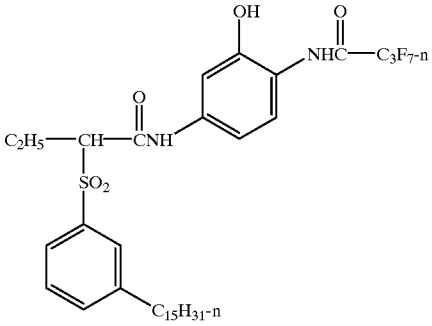
C-13
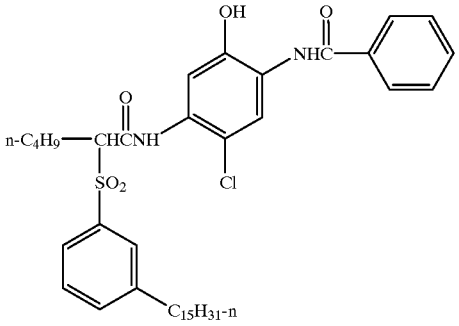
-continued
C-14
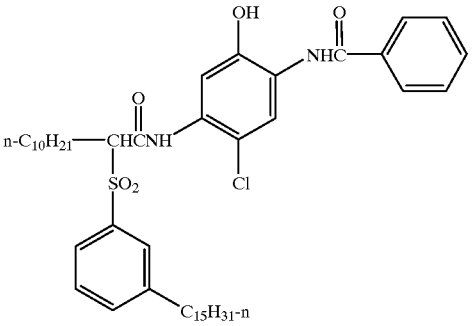
C-15
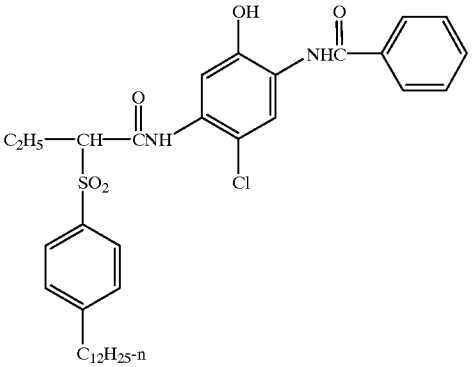
C-16
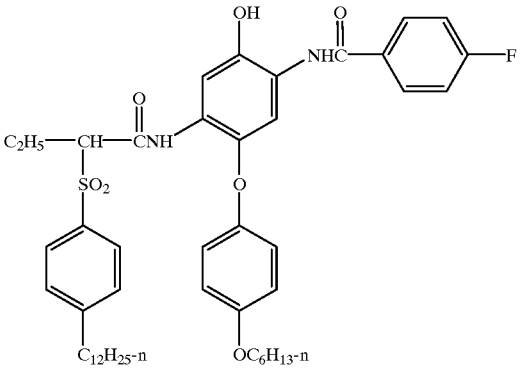
C-17
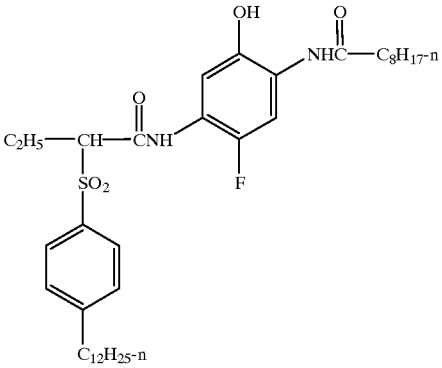

-continued
C-18
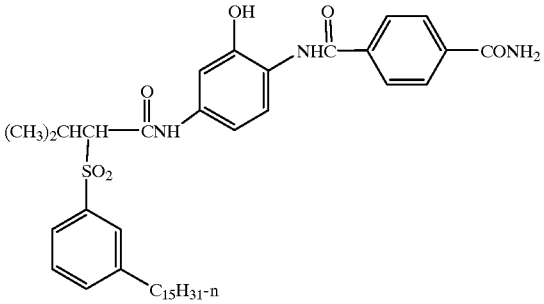
C-19
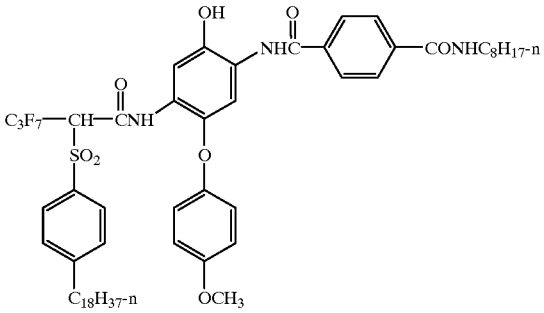
C-20
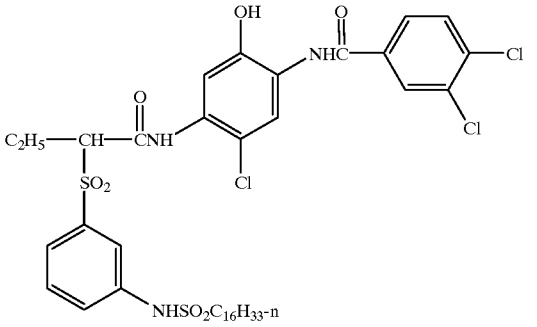
C-21
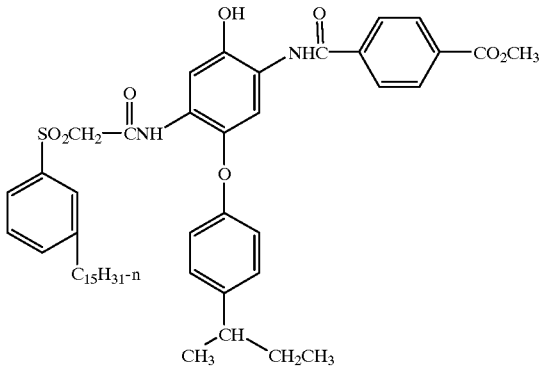
-continued
C-22
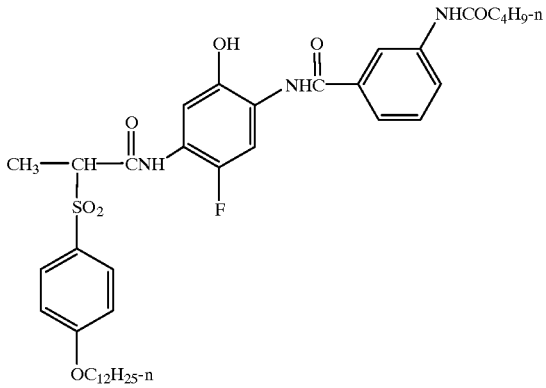
C-23
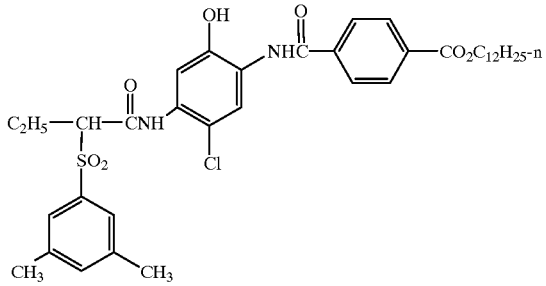
C-24
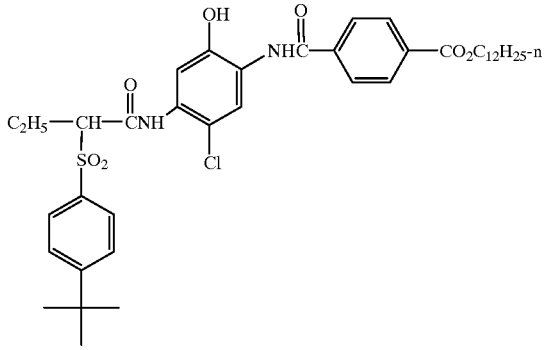
C-25
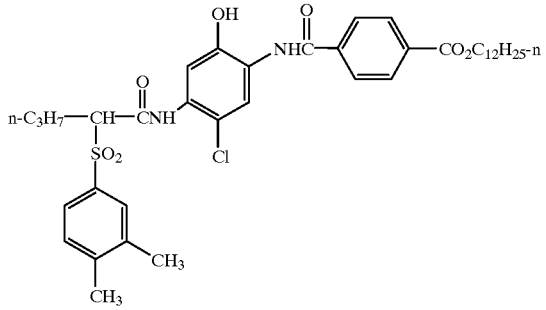

-continued
C-26
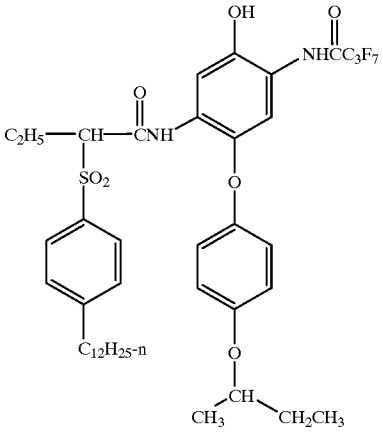
C-27
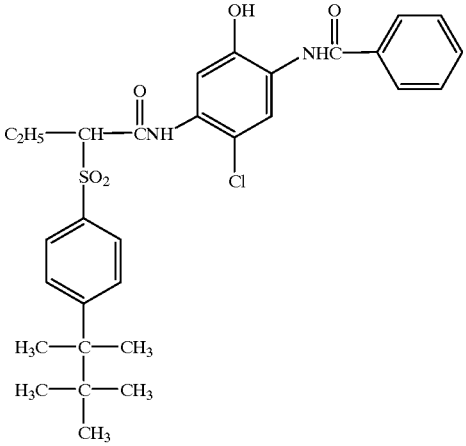
C-28
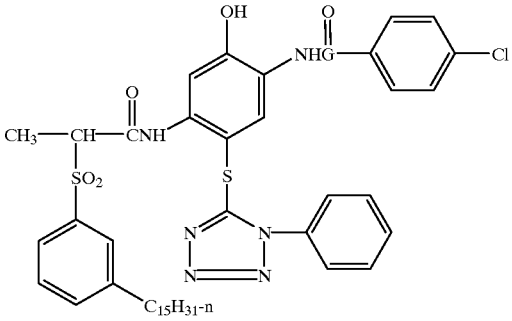
-continued
C-29
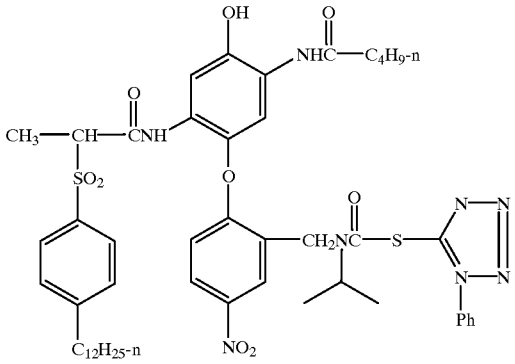
C-30
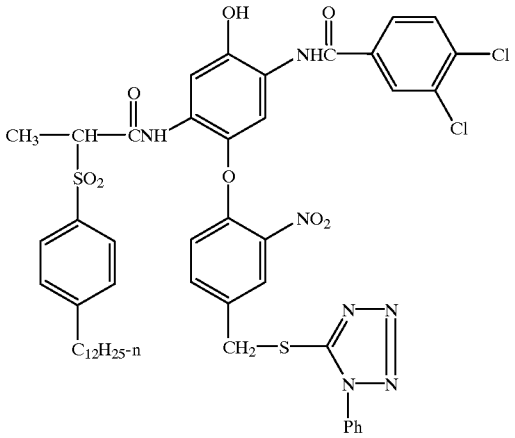
C-31
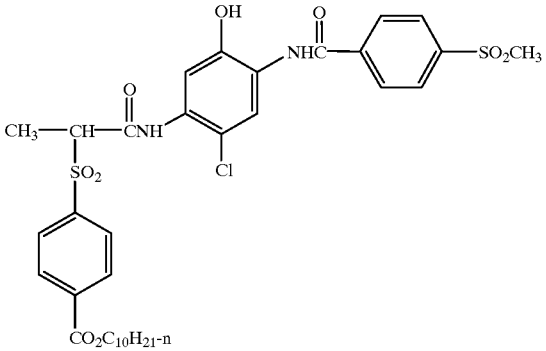
C-32
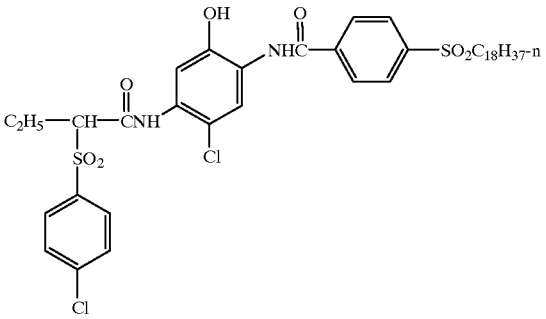

-continued

C-33

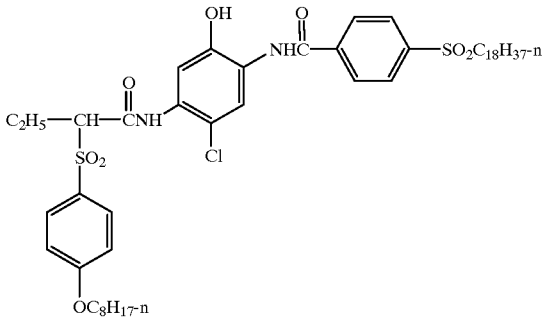

C-34

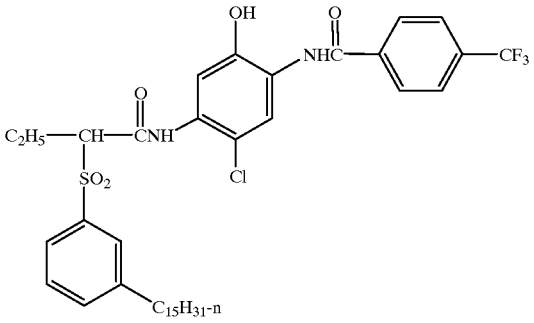

C-35

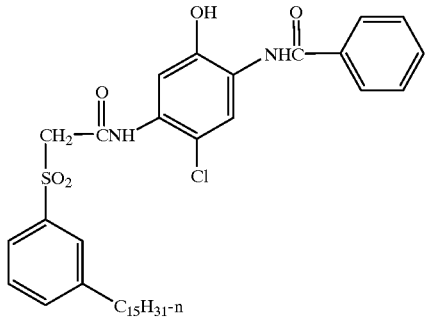

C-36

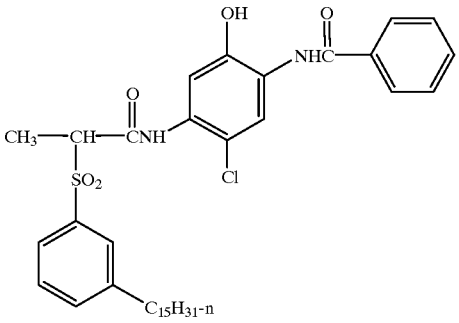

Magenta Image Couplers

The magenta image coupler utilized in the invention may be any magenta imaging coupler known in the art. Suitable is a pyrazole of the following structure:

II

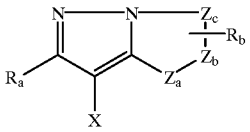

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Preferred magenta couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Pat. Nos. 4,659,652; 5,066,575; and 5,250,400.

In particular, pyrazoloazole magenta couplers of general structures PZ-1 and PZ-2 are suitable:

PZ-1

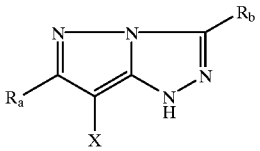

PZ-2

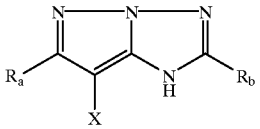

wherein $R_a$, $R_b$, and X are as defined for formula (II).

Particularly preferred are the two-equivalent versions of magenta couplers PZ-1 and PZ-2 wherein X is not hydrogen. This is the case because of the advantageous drop in silver required to reach the desired density in the print element.

Other examples of suitable magenta couplers are those based on pyrazolones as described hereinafter.

Typical magenta couplers that may be used in the inventive photographic element are shown below.

M-1
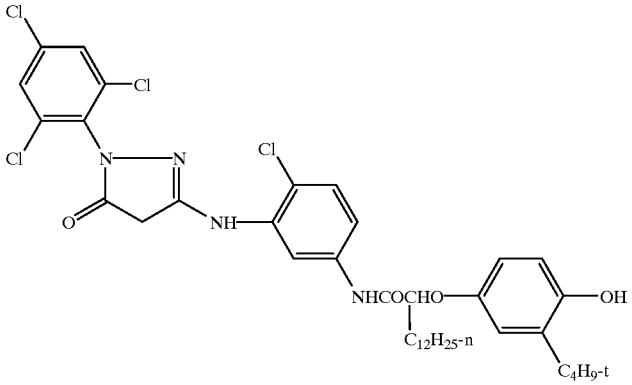
M-2
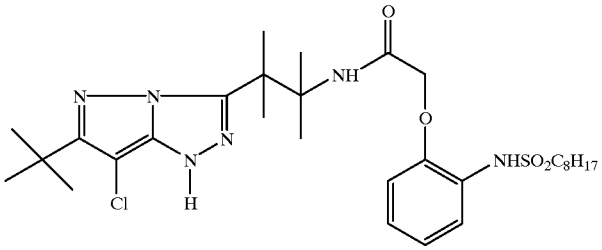
M-3
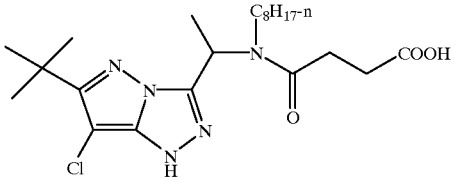
M-4
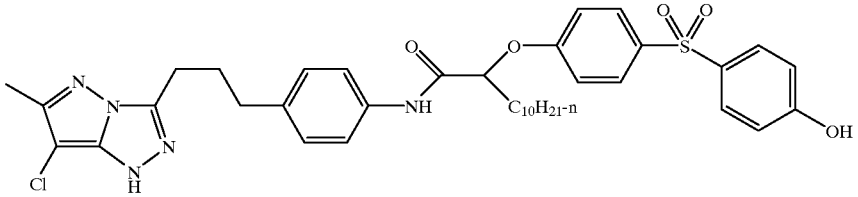
M-5
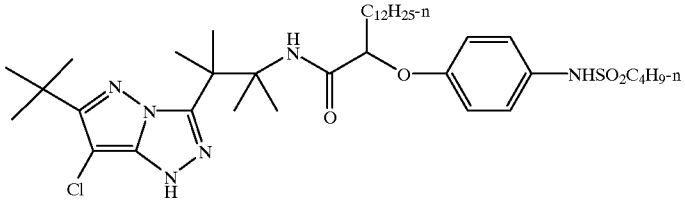
M-6
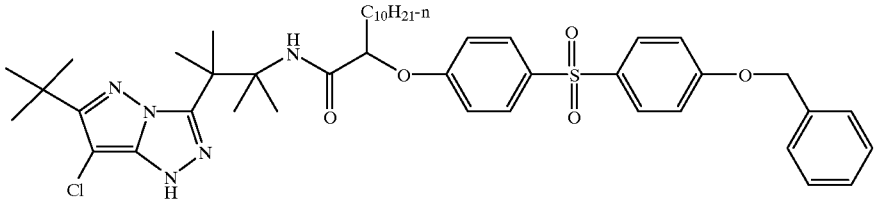

-continued

M-7

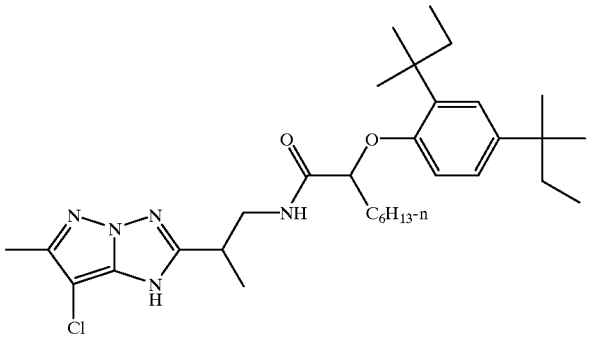

M-8

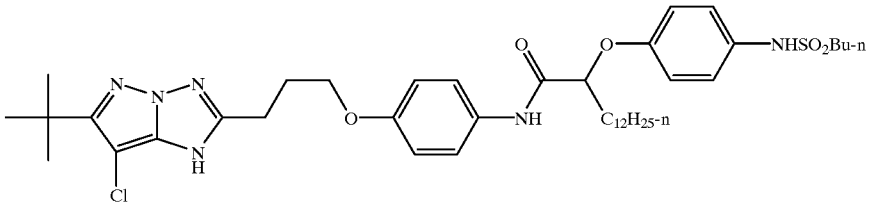

M-9

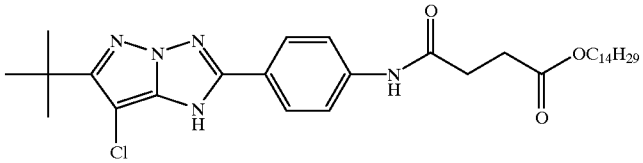

The coupler identified as M-2 is useful because of its narrow absorption band.

Yellow Image Couplers

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler-Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

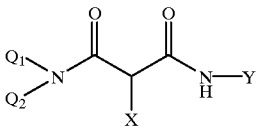

YELLOW-2

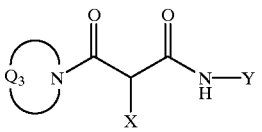

-continued

YELLOW-3

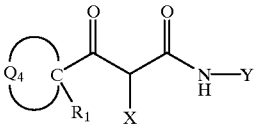

YELLOW-4

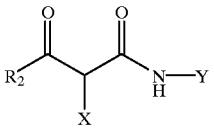

YELLOW-5

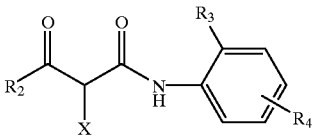

wherein $R_1$, $R_2$, $R_3$, $R_4$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group.

The most preferred yellow couplers are represented by YELLOW-5, wherein $R_2$ represents a tertiary alkyl group, $R_3$ represents a halogen or an alkoxy substituent, $R_4$ represents a substituent and X represents a N-heterocyclic coupling-off group because of their good development and desirable color.

Even more preferred are yellow couplers are represented by YELLOW-5, wherein $R_2$, $R_3$ and $R_4$ are as defined above, and X is represented by the following formula:

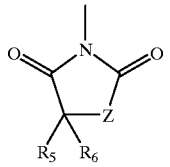

wherein Z is oxygen of nitrogen and $R_5$ and $R_6$ are substituents. Most preferred are yellow couplers wherein Z is oxygen and $R_5$ and $R_6$ are alkyl groups.

Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arylsulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Examples of the yellow couplers suitable for use in the invention are the acylacetanilide couplers, such as those having formula III:

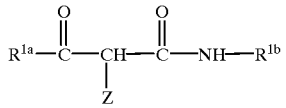

III wherein Z represents hydrogen or a coupling-off group bonded to the coupling site in each of the above formulae. In the above formulae, when $R^{1a}$, $R^{1b}$, $R^{1d}$, or $R^{1f}$ contains a ballast or anti-diffusing group, it is selected so that the total number of carbon atoms is at least 8 and preferably at least 10.

$R^{1a}$ represents an aliphatic (including alicyclic) hydrocarbon group, and $R^{1b}$ represents an aryl group.

The aliphatic- or alicyclic hydrocarbon group represented by $R^{1a}$ typically has at most 22 carbon atoms, may be substituted or unsubstituted, and aliphatic hydrocarbon may be straight or branched. Preferred examples of the substituent for these groups represented by $R^{1a}$ are an alkoxy group, an aryloxy group, an amino group, an acylamino group, and a halogen atom. These substituents may be further substituted with at least one of these substituents repeatedly. Useful examples of the groups as $R^{1a}$ include an isopropyl group, an isobutyl group, a tert-butyl group, an isoamyl group, a tert-amyl group, a 1,1 -dimethyl-butyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an a-aminoisopropyl group, an a-(diethylamino)isopropyl group, an a-(succinimido) isopropyl group, an a-phthalimido)isopropyl group, an a-(benzenesulfonamido)isopropyl group, and the like.

As an aryl group, (especially a phenyl group), $R^{1b}$ may be substituted. The aryl group (e.g., a phenyl group) may be substituted with substituent groups typically having not more than 32 carbon atoms such as an alkyl group, an alkenyl group, an alkoxy group, an alkoxycarbonyl group, an alkoxycarbonylamino group, an aliphatic- or alicyclic-amido group, an alkylsulfamoyl group, an alkylsulfonamido group, an alkylureido group, an aralkyl group and an alkyl-substituted succinimido group. This phenyl group in the aralkyl group may be further substituted with groups such as an aryloxy group, an aryloxycarbonyl group, an arylcarbamoyl group, an arylamido group, an arylsulfamoyl group, an arylsulfonamido group, and an arylureido group.

The phenyl group represented by $R^{1b}$ may be substituted with an amino group which may be further substituted with a lower alkyl group having from 1 to 6 carbon atoms, a hydroxyl group, —COOM and —$SO_2$M (M=H, an alkali metal atom, $NH_4$), a nitro group, a cyano group, a thiocyano group, or a halogen atom.

In a preferred embodiment, the phenyl group represented by $R^{1b}$ is a phenyl group having in the position ortho to the anilide nitrogen a halogen such as fluorine, chlorine or an alkoxy group such as methoxy, ethoxy, propoxy, butoxy. Alkoxy groups of less than 8 carbon atoms are preferred.

$R^{1b}$ may represent substituents resulting from condensation of a phenyl group with other rings, such as a naphthyl group, a quinolyl group, an isoquinolyl group, a chromanyl group, a coumaranyl group, and a tetrahydronaphthyl group. These substituents may be further substituted repeatedly with at least one of above-described substituents for the phenyl group.

$R^{1d}$ and $R^{1f}$ represent a hydrogen atom, or a substituent group (as defined hereafter in the passage directed to substituents).

Representative examples of yellow couplers useful in the present invention are as follows:

Y-1
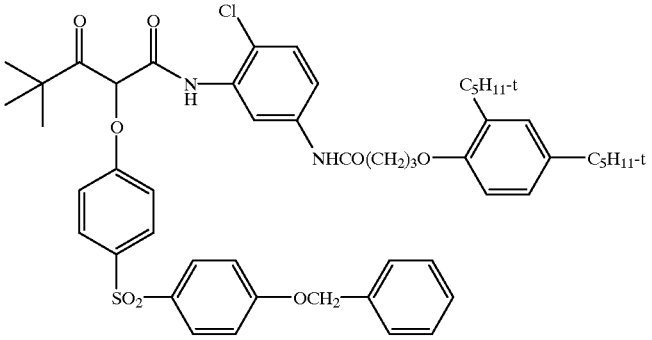
Y-2
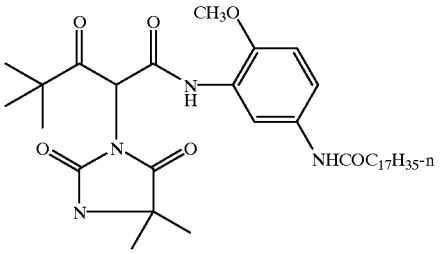
Y-3
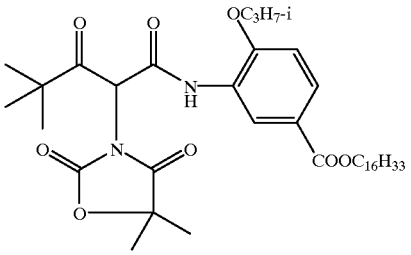
Y-4
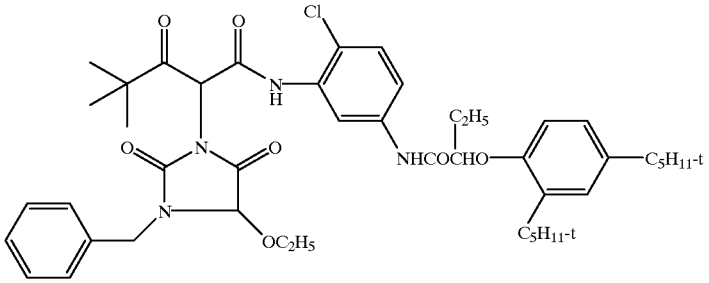
Y-5
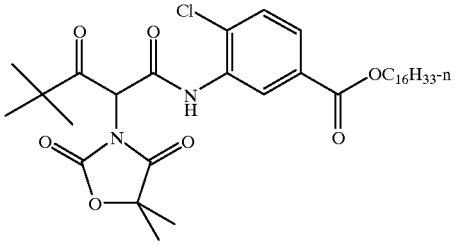

-continued
Y-6
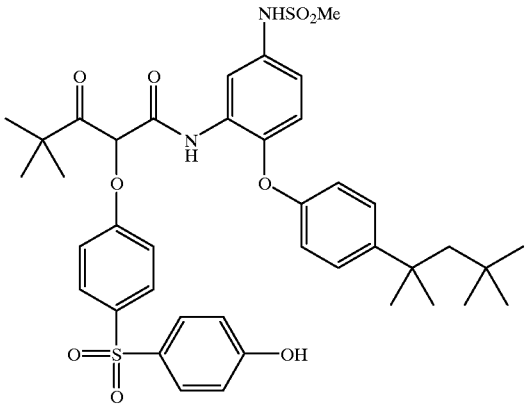
Y-7
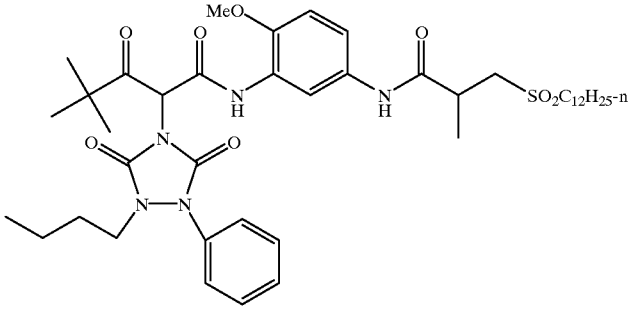
Y-8
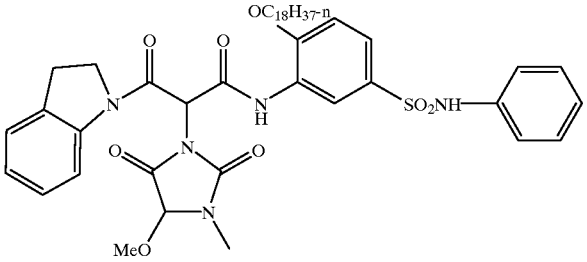
Y-9
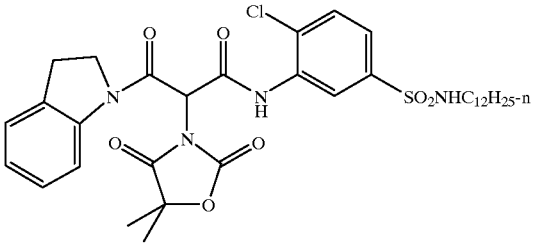
Y-10
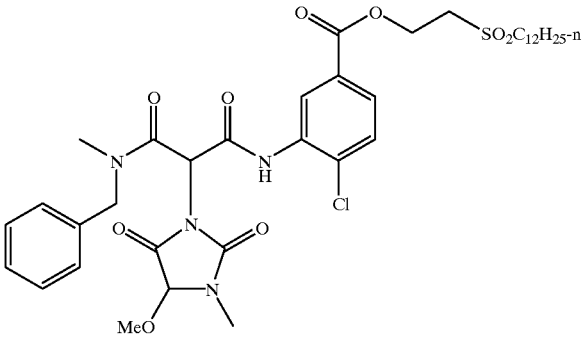

-continued

Y-11

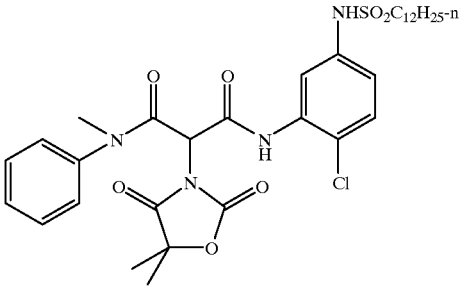

Y-12

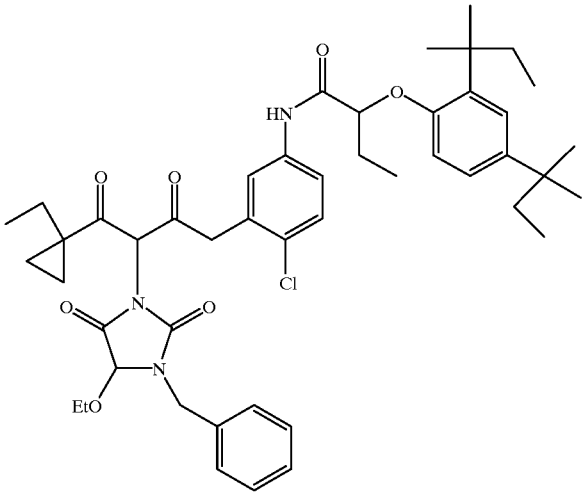

Throughout this specification, unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The color photographic elements of the invention are multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one light-sensitive silver halide emulsion layer having associated therewith at least one cyan dye-forming coupler, a magenta dye image-forming unit comprising at least one light-sensitive silver halide emulsion layer having associated therewith at least one magenta dye-forming coupler, a yellow dye image-forming unit comprising at least one light-sensitive silver halide emulsion layer having associated therewith at least one yellow dye-forming coupler, and an 'blue' dye image-forming unit comprising at least one light-sensitive silver halide emulsion layer having associated therewith at least one 'blue' dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94–6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure,* Item 37038, February 1995.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298, 443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. Nos. 4,301,235; 4,853, 319 and 4,351,897. The coupler may contain solubilizing groups such as described in U.S. Pat. No. 4,482,629.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163, 669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, 'blue', cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384, 657; 3,379,529; 3,615,506; 3,617,291; 3,620,746; 3,701, 783; 3,733,201; 4,049,455; 4,095,984; 4,126,459; 4,149, 886; 4,150,228; 4,211,562; 4,248,962; 4,259,437; 4,362, 878; 4,409,323; 4,477,563; 4,782,012; 4,962,018; 4,500, 634; 4,579,816; 4,607,004; 4,618,571; 4,678,739; 4,746, 600; 4,746,601; 4,791,049; 4,857,447; 4,865,959; 4,880, 342; 4,886,736; 4,937,179; 4,946,767; 4,948,716; 4,952, 485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

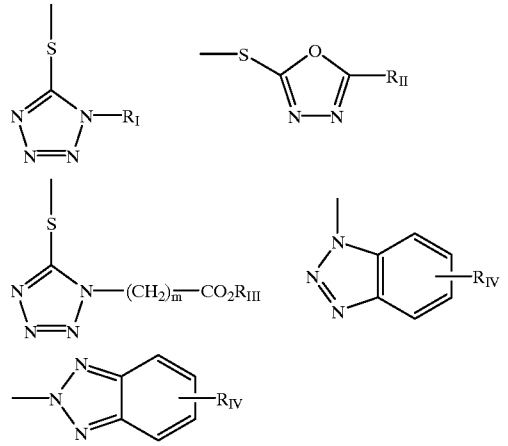

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

It is contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90–072, 629, 90–072,630; 90–072,631; 90–072,632; 90–072,633; 90–072,634; 90–077,822; 90–078,229; 90–078,230; 90–079,336; 90–079,337; 90–079,338; 90–079,690; 90–079,691; 90–080,487; 90–080,488; 90–080,489; 90–080,490; 90–080,491; 90–080,492; 90–080,494; 90–085,928; 90–086,669; 90–086,670; 90–087,360; 90–087,361; 90–087,362; 90–087,363; 90–087,364; 90–088,097; 90–093,662; 90– 093,663; 90–093,664; 90–093,665; 90–093,666; 90–093,668; 90–094,055; 90–094,056; 90–103,409; 83–62,586; 83–09,959.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in USSN 07/978,589 filed Nov. 19, 1992, and USSN 07/978,568 filed Nov. 19, 1992, both granted, in conjunction with elements of the invention.

In addition, emulsions can be sensitized with mixtures of two or more sensitizing dyes which form mixed dye aggregates on the surface of the emulsion grain. The use of mixed dye aggregates enables adjustment of the spectral sensitivity of the emulsion to any wavelength between the extremes of the wavelengths of peak sensitivities (λ-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the λ-max of the image dye in the color negative produces the optimum preferred response.

In addition, emulsions of this invention may contain a mixture of spectral sensitizing dyes which are substantially different in their light absorptive properties. For example, Hahm, in U.S. Pat. No. 4,902,609, describes a method for broadening the effective exposure latitude of a color negative paper by adding a smaller amount of green spectral sensitizing dye to a silver halide emulsion having predominately a red spectral sensitivity. Thus when the red sensitized emulsion is exposed to green light, it has little, if any, response. However, when it is exposed to larger amounts of green light, a proportionate amount of cyan image dye will be formed in addition to the magenta image dye, causing it to appear to have additional contrast and hence a broader exposure latitude.

Waki et al. in U.S. Pat. No. 5,084,374, describes a silver halide color photographic material in which the red spectrally sensitized layer and the green spectrally sensitized layers are both sensitized to blue light. Like Hahm, the second sensitizer is added in a smaller amount to the primary sensitizer. When these imaging layers are given a large enough exposure of the blue light exposure, they produce yellow image dye to complement the primary exposure. This process of adding a second spectral sensitizing dye of different primary absorption is called false-sensitization.

Any silver halide combination can be used, such as silver chloride, silver chlorobromide, silver chlorobromoiodide, silver bromide, silver bromoiodide, or silver chloroiodide. Due to the need for rapid processing of the color paper, silver chloride emulsions are preferred. In some instances, silver chloride emulsions containing small amounts of bromide, or iodide, or bromide and iodide are preferred, generally less than 2.0 mole percent of bromide less than 1.0 mole percent of iodide. Bromide or iodide addition when forming the emulsion may come from a soluble halide source such as potassium iodide or sodium bromide or an organic bromide or iodide or an inorganic insoluble halide such as silver bromide or silver iodide.

The shape of the silver halide emulsion grain can be cubic, pseudo-cubic, octahedral, tetradecahedral or tabular. It is preferred that the 3-dimensional grains be monodisperse and that the grain size coefficient of variation of the 3-dimensional grains is less than 35% or, most preferably less than 25%. The emulsions may be precipitated in any suitable environment such as a ripening environment, or a reducing environment. Specific references relating to the preparation of emulsions of differing halide ratios and morphologies are Evans U.S. Pat. No. 3,618,622; Atwell U.S. Pat. No. 4,269,927; Wey U.S. Pat. No. 4,414,306; Maskasky U.S. Pat. No. 4,400,463; Maskasky U.S. Pat. No. 4,713,323; Tufano et al U.S. Pat. No. 4,804,621; Takada et al U.S. Pat. No. 4,738,398; Nishikawa et al U.S. Pat. No. 4,952,491; Ishiguro et al U.S. Pat. No. 4,493,508; Hasebe et al U.S. Pat. No. 4,820,624; Maskasky U.S. Pat. No. 5,264, 337; and Brust et al EP 534,395.

The combination of similarly spectrally sensitized emulsions can be in one or more layers, but the combination of emulsions having the same spectral sensitivity should be such that the resultant D vs. log-E curve and its corresponding instantaneous contrast curve should be such that the instantaneous contrast of the combination of similarly spectrally sensitized emulsions generally increases as a function of exposure.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations of these basic parameters are illustrated by the citations including emulsion precipitation descriptions and are further illustrated by Matsuzaka et al U.S. Pat. No. 4,497,895, Yagi et al U.S. Pat. No. 4,728,603, Sugimoto U.S. Pat. No. 4,755,456, Kishita et al U.S. Pat. No. 4,847,190, Joly et al U.S. Pat. No. 5,017, 468, Wu U.S. Pat. No. 5,166,045, Shibayama et al EPO 0 328 042, and Kawai EPO 0 531 799.

Reducing agents present in the dispersing medium during precipitation can be employed to increase the sensitivity of the grains, as illustrated by Takada et al U.S. Pat. No. 5,061,614, Takada U.S. Pat. No. 5,079,138 and EPO 0 434 012, Inoue U.S. Pat. No. 5,185,241, Yamashita et al EPO 0 369 491, Ohashi et al EPO 0 371 338, Katsumi EPO 435 270 and 0 435 355 and Shibayama EPO 0 438 791. Chemically sensitized core grains can serve as hosts for the precipitation of shells, as illustrated by Porter et al U.S. Pat. Nos. 3,206,313 and 3,327,322, Evans U.S. Pat. No. 3,761,276, Atwell et al U.S. Pat. No. 4,035,185 and Evans et al U.S. Pat. No. 4,504,570.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", Photographic Science and Engineering, Vol. 24, No. 6 Nov./Dec. 1980, pp. 265–267 (pm, Ir, a, b and d); Hochstetter U.S. Pat. No. 1,951,933 (Cu); De Witt U.S. Pat. No. 2,628,167 (Tl, a, c); Mueller et al U.S. Pat. No. 2,950,972 (Cd, j); Spence et al U.S. Pat. No. 3,687,676 and Gilman et al U.S. Pat. No. 3,761,267 (Pb, Sb, Bi, As, Au, Os, Ir, a); Ohkubu et al U.S. Pat. No. 3,890,154 (VIII, a); Iwaosa et al U.S. Pat. No. 3,901,711 (Cd, Zn, Co, Ni, Tl, U, Th, Ir, Sr, Pb, b1); Habu et al U.S. Pat. No. 4,173,483 (VIII, b1); Atwell U.S. Pat. No. 4,269,927 (Cd, Pb, Cu, Zn, a2); Weyde U.S. Pat. No. 4,413,055 (Cu, Co, Ce, a2); Akimura et al U.S. Pat. No. 4,452,882 (Rh, i); Menjo et al U.S. Pat. No. 4,477,561 (pm, f); Habu et al U.S. Pat. No. 4,581,327 (Rh, cl, i); Kobuta et al U.S. Pat. No. 4,643,965 (VIII, Cd, Pb, f, c2); Yamashita et al U.S. Pat. No. 4,806,462 (pvmi, a2, g); Grzeskowiak et al U.S. Pat. No. 4,4,828,962 (Ru+Ir, b1); Janusonis U.S. Pat. No. 4,835,093 (Re, a1); Leubner et al U.S. Pat. No. 4,902,611 (Ir+4); Inoue et al U.S. Pat. No. 4,981,780 (Mn, Cu, Zn, Cd, Pb, Bi, In, Tl, Zr, La, Cr, Re, VIII, c1, g, h); Kim U.S. Pat. No. 4,997,751 (Ir, b2); Kuno U.S. Pat. No. 5,057,402 (Fe, b, f); Maekawa et al U.S. Pat. No. 5,134,060 (Ir, b, c3); Kawai et al U.S. Pat. No. 5,164,292 (Ir+Se, b); Asami U.S. Pat. Nos. 5,166,044 and 5,204,234 (Fe+Ir, a2 b, c1, c3); Wu U.S. Pat. No. 5,166,045 (Se, a2); Yoshida et al U.S. Pat. No. 5,229,263 (Ir+Fe/Re/Ru/Os, a2, b1); Marchetti et al U.S. Pat. Nos. 5,264,336 and 5,268,264 (Fe, g); Komarita et al EPO 0 244 184 (Ir, Cd, Pb, Cu, Zn, Rh, Pd, Pt, Tl, Fe, d); Miyoshi et al EPO 0 488 737 and 0 488 601 (Ir+VIII/Sc/Ti/V/Cr/Mn/Y/Zr/Nb/Mo/La/Ta/W/Re, a2, b, g); Ihama et al EPO 0 368 304 (Pd, a2, g); Tashiro EPO 0 405 938 (Ir, a2, b); Murakami et al EPO 0 509 674 (VIII, Cr, Zn, Mo, Cd, W, Re, Au, a2, b, g) and Budz WO 93/02390 (Au, g); Ohkubo et al U.S. Pat. No. 3,672,901 (Fe, a2, o1); Yamasue et al U.S. Pat. No. 3,901,713 (Ir+Rh, f); and Miyoshi et al EPO 0 488 737.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, nitrosyl, thionitrosyl, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781, and 5,037,732; Marchetti et al U.S. Pat. No. 4,937,180; Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320, and Olm et al U.S. Ser. No. 08/091,148.

Oligomeric coordination complexes can also be employed to modify grain properties, as illustrated by Evans et al U.S. Pat. No. 5,024,931.

Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965 (Ir, a2); Shiba et al U.S. Pat. No. 3,790,390 (Group VIII, a2, b1); Habu et al U.S. Pat. No. 4,147,542 (Group VIII, a2, b1); Hasebe et al EPO 0 273 430 (Ir, Rh, Pt); Ohshima et al EPO 0 312 999 (Ir, f); and Ogawa U.S. Statutory Invention Registration H760 (Ir, Au, Hg, Ti, Cu, Pb, Pt, Pd, Rh, b, f).

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$, and $K_2Os(NS)Cl_5$. Amine, oxalate, and organic ligand complexes of these or other metals as disclosed in Olm et al U.S. Ser. No. 08/091,148 are also specifically contemplated.

Shallow electron trapping ions or complexes are dopants which introduce additional net positive charge on a lattice site of the host grain, and which also fail to introduce an additional empty or partially occupied energy level deep within the bandgap of the host grain. For the case of a six coordinate transition metal dopant complex, substitution into the host grain involves omission from the crystal structure of a silver ion and six adjacent halide ions (collectively referred to as the seven vacancy ions). The seven vacancy ions exhibit a net charge of −5. A six coordinate dopant complex with a net charge more positive than −5 will introduce a net positive charge onto the local lattice site and can function as a shallow electron trap. The presence of additional positive charge acts as a scattering center through the Coulomb force, thereby altering the kinetics of latent image formation.

Based on electronic structure, common shallow electron trapping ions or complexes can be classified as metal ions or complexes which have (i) a filled valence shell or (ii) a low spin, half-filled d shell with no low-lying empty or partially filled orbitals based on the ligand or the metal due to a large crystal field energy provided by the ligands. Classic examples of class (i) type dopants are divalent metal complex of Group II, e.g., Mg(2+), Pb(2+), Cd(2+), Zn(2+), Hg(2+), and Tl(3+). Some type (ii) dopants include Group VIII complex with strong crystal field ligands such as cyanide and thiocyanate. Examples include, but are not limited to, iron complexes illustrated by Ohkubo U.S. Pat. No. 3,672,901; and rhenium, ruthenium, and osmium complexes disclosed by Keevert U.S. Pat. No. 4,945,035; and iridium and platinum complexes disclosed by Ohshima et al U.S. Pat. No. 5,252,456. Preferred complexes are ammonium and alkali metal salts of low valent cyanide complexes such as $K_4Fe(CN)_6$, $K_4Ru(CN)_6$, $K_4Os(CN)_6$, $K_2Pt(CN)_4$, and $K_3Ir(CN)_6$. Higher oxidation state complexes of this type, such as $K_3Fe(CN)_6$ and $K_3Ru(CN)_6$, can also possess shallow electron trapping characteristics, particularly when any partially filled electronic states which might reside within the bandgap of the host grain exhibit limited interaction with photocharge carriers.

Emulsion addenda that absorb to grain surfaces, such as antifoggants, stabilizers and dyes can also be added to the emulsions during precipitation. Precipitation in the presence of spectral sensitizing dyes is illustrated by Locker U.S. Pat. No. 4,183,756, Locker et al U.S. Pat. No. 4,225,666, Ihama et al U.S. Pat. Nos. 4,683,193 and 4,828,972, Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EPO 0 287 100 and Tadaaki et al EPO 0 301 508. Non-dye addenda are illustrated by Klotzer et al U.S. Pat. No. 4,705,747, Ogi et al U.S. Pat. No. 4,868,102, Ohya et al U.S. Pat. No. 5,015,563, Bahnmuller et al U.S. Pat. No. 5,045,444, Maeka et al U.S. Pat. No. 5,070,008, and Vandenabeele et al EPO 0 392 092.

Chemical sensitization of the materials in this invention is accomplished by any of a variety of known chemical sensitizers. The emulsions described herein may or may not have other addenda such as sensitizing dyes, supersensitizers, emulsion ripeners, gelatin or halide conversion restrainers present before, during or after the addition of chemical sensitization.

The use of sulfur, sulfur plus gold or gold only sensitizations are very effective sensitizers. Typical gold sensitizers are chloroaurates, aurous dithiosulfate, aqueous colloidal gold sulfide or gold (aurous bis(1,4,5-trimethyl-1,2,4-triazolium-3-thiolate) tetrafluoroborate. Sulfur sensitizers may include thiosulfate, thiocyanate or N, N'-carbobothioyl-bis(N-methylglycine).

The addition of one or more antifoggants as stain reducing agents is also common in silver halide systems. Tetrazaindenes, such as 4-hydroxy-6-methyl-(1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfinates, such as tolylthiosulfonate or arylsufinates such as tolylthiosulfinate or esters thereof are also useful.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T = ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak RA-4 color process as described the British Journal of Photography Annual of 1988, pp 198–199. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride,
4-amino-3-methyl-N,N-diethylaniline hydrochloride,
4-amino-3-methyl-N-ethyl-N-(2-methanesulfonamidoethyl)aniline sesquisulfate hydrate,
4-amino-3-methyl-N-ethyl-N-(2-hydroxyethyl)aniline sulfate,
4-amino-3-(2-methanesulfonamido-ethyl)-N,N-diethylaniline hydrochloride and
4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

A direct-view photographic element is defined as one which yields a color image that is designed to be viewed directly (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by optically printing an image from a color negative onto the direct-viewing element and processing though an appropriate negative-working photographic process to give a positive color image. Color slides may be produced in a similar manner but are more typically produced by exposing the film directly in a camera and processing through a reversal color process or a direct positive process to give a positive color image. The image may also be produced by alternative processes such as digital printing.

Each of these types of photographic elements has its own particular requirements for dye hue, but in general they all require cyan dyes that whose absorption bands are less deeply absorbing (that is, shifted away from the red end of the spectrum) than color negative films. This is because dyes in direct viewing elements are selected to have the best appearance when viewed by human eyes, whereas the dyes in color negative materials designed for optical printing are designed to best match the spectral sensitivities of the print materials.

PHOTOGRAPHIC EXAMPLES

EXAMPLE 1

Single Layer Coating Containing a Red Sensitized Emulsion and Red Dye-Forming Couplers A silver chloride emulsion was chemically and spectrally sensitized as is described below.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 $\mu$m in edge length. In addition, ruthenium hexacyanide dopant (at 16.5 mg/Ag-M) and $K_2IrCl_5$(5-methylthiazole) dopant (at 0.99 mg/Ag-M) was added during the precipitation process. This emulsion was optimally sensitized by the addition of a colloidal suspension of aurous sulfide (60 mg/Ag-M) followed by a heat ramp to 65° C. for 45 minutes, and further additions of 1-(3-acetamidophenyl)-5-mercaptotetrazole (295 mg/Ag-M), iridium dopant, $K_2IrCl_6$ (149 $\mu$g/Ag-M), potassium bromide, (0.5 Ag-M %), and red sensitizing dye RSD-1 (7.1 mg/Ag-M).

Dispersions of example couplers, were emulsified by methods well known to the art, and were coated on the face side of a doubly extruded polyethylene coated color paper support using conventional coating techniques. The gelatin layers were hardened with bis (vinylsulfonyl methyl) ether at 2.4% of the total gelatin. The composition of the individual layers is given as follows:

Single Layer Coating Evaluation Format

The emulsion described above was first evaluated in a single emulsion layer-coating format using conventional coating preparation methods and techniques. This coating format is described below in detail:

TABLE 1

Single Layer Coating Format

| Layer | Coating Material | Coverage mg/M$^2$ |
|---|---|---|
| Overcoat | Gelatin | 1064. |
| | Gel hardener | 105. |
| Imaging | Emulsion Red EM-1 | Varies between 75.3 and 322.8 |
| | Couplers C-1 to C-32 Or M1, M2, Y3, or Y5 | Varies between 237 to 323 |
| | Gelatin | 1658. |
| Adhesion sub-layer | Gelatin | 3192. |
| Polyethylene coated paper support | | |

Once the coated paper samples described above had been prepared they were given a preliminary evaluation as follows:

The respective paper samples were exposed in a Kodak Model 1B sensitometer with a color temperature of 3000° K and filtered and blue with a Kodak Wratten™ 2C plus a Kodak Wratten™ 29 filter and a Hoya HA-50. Exposure time was adjusted to 0.1 seconds. The exposures were performed by contacting the paper samples with a neutral density step exposure tablet having an exposure range of 0 to 3 log-E.

The paper samples described above as coating examples 1 to 20 were processed in the Kodak Ektacolor RA-4 Color Development™ process. The color developer and bleach-fix formulations are described below in Tables 2 and 3. The chemical development process cycle is described in Table 4.

TABLE 2

Kodak Ektacolor ™ RA-4 Color Developer

| Chemical | Grams/Liter |
|---|---|
| Triethanol amine | 12.41 |
| Phorwite REU ™ | 2.30 |
| Lithium polystyrene sulfonate (30%) | 0.30 |
| N,N-diethylhydroxylamine (85%) | 5.40 |
| Lithium sulfate | 2.70 |
| Kodak color developer CD-3 | 5.00 |
| DEQUEST 2010 ™ (60%) | 1.16 |
| Potassium carbonate | 21.16 |
| Potassium bicarbonate | 2.79 |
| Potassium chloride | 1.60 |
| Potassium bromide | 0.007 |
| Water | to make 1 liter |

pH @ 26.7° C. is 10.04 +/− 0.05

TABLE 3

Kodak Ektacolor ™ RA-4 Bleach-Fix

| Chemical | Grams/Liter |
|---|---|
| Ammonium thiosulfate (56.5%) | 127.40 |
| Sodium metabisulfite | 10.00 |
| Glacial acetic acid | 10.20 |
| Ammonium ferric EDTA (44%) | 110.40 |
| Water | to make 1 liter |

pH @ 26.7° C. is 5.5 +/− 0.10

TABLE 4

Kodak Ektacolor ™ RA-4 Color Paper Process

| Process Step | Time (seconds) |
|---|---|
| Color Development | 45 |
| Bleach-fix | 45 |
| Wash | 90 |
| Dry | |

Processing the exposed paper samples is performed with the developer and bleach-fix temperatures adjusted to 35° C. Washing is performed with tap water at 32.2° C.

To facilitate comparisons, the characteristic vector, also determined from principle component analysis was determined using standard characterization methods as described earlier, since the absorption characteristics of a given colorant will vary to some extent with a change in colorant amount. This is due to factors such as measurement flare, colorant-colorant interaction, colorant-support interactions, colorant concentration effects and the presence of color impurities in the media. However, by using characteristic vector analysis, one can determine a characteristic absorption curve that is representative of the absorption characteristics of the colorant over the complete wavelength and density ranges of interest. This technique is described by J. L. Simonds in the Journal of the Optical Society of America, 53(8), 968–974, 1963.

The spectral absorption curve of each dye was measured and blue using a MacBeth Model 2145 Reflection Spectrophotometer having a Xenon pulsed source and a 10 nm nominal aperture. Reflection measurements were made over the wavelength range of 380–750 nanometers using a measurement geometry of 45/0, and the characteristic vector (transmission density —vs.—wavelength) for each coupler specimen was calculated. The hue angles of the resulting dyes were calculated from the colorimetry of the characteristic vectors.

The λ-max (normalized to 1.0 density) of the characteristic vector of each dye and the hue-angle of each dye was calculated and is summarized in Table 5 below:

TABLE 5

λ-Max and Hue-Angle of Conventional and Comparative Dye Forming Couplers

| Coupler type | Coupler | λ-max of Dye Vector @ 1.0 Density | Hue-angle |
|---|---|---|---|
| Conventional | C-1 | 660 nm | 212 |
| " | C-2 | 630 nm | 210 |
| " | M-1 | 540 nm | 333 |
| " | M-2 | 550 nm | 329 |
| " | Y-3 | 440 nm | 94 |
| " | Y-5 | 450 nm | 86 |
| Comparative Blue | CB-1 | 750 nm | 211 |
| " | CB-2 | 695 nm | 210 |
| " | CB-3 | 630 nm | 218 |
| " | CB-4 | 560 nm | 315 |
| " | CB-5 | 560 nm | 321 |
| Comparative Red | CR-1 | 510 nm | 344 |
| " | CR-2 | 560 nm | 321 |
| " | CR-3 | 550 nm | 329 |
| " | CR-4 | 560 nm | 315 |
| " | CR-5 | 450 nm | 84 |

Comparative couplers as identified for the red comparisons were as follows:

CR-1

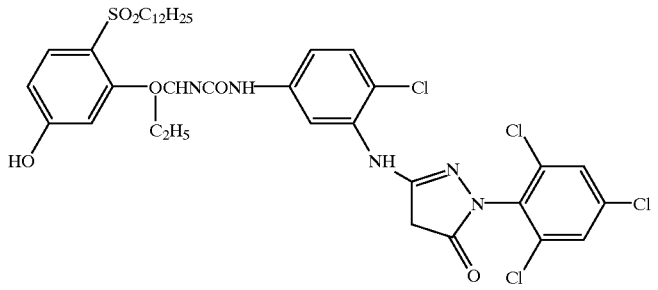

-continued
CR-2
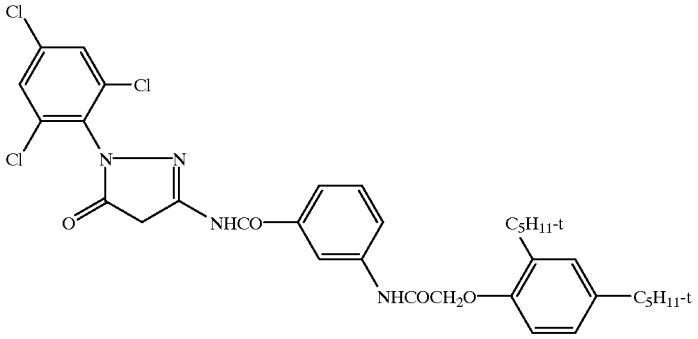
CR-3
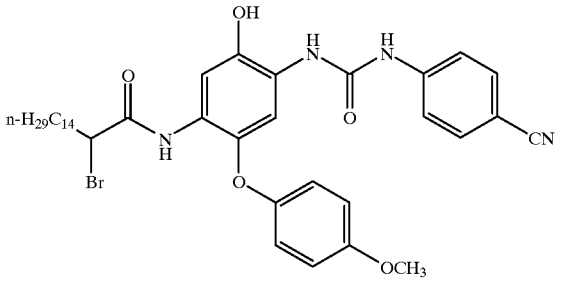
CR-4
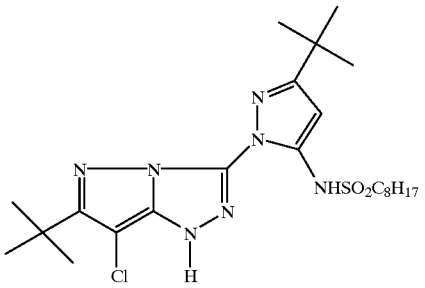
CR-5
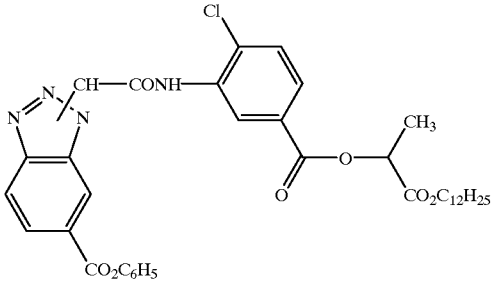

Comparative couplers as identified for the blue comparisons were as follows:
Comp-1
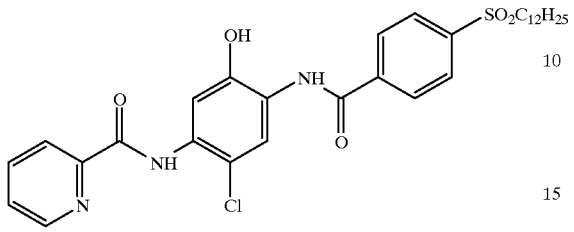
Comp-2
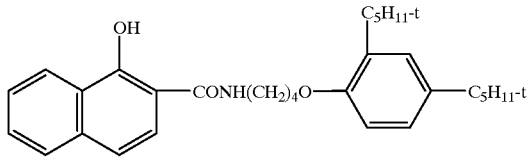
Comp-3
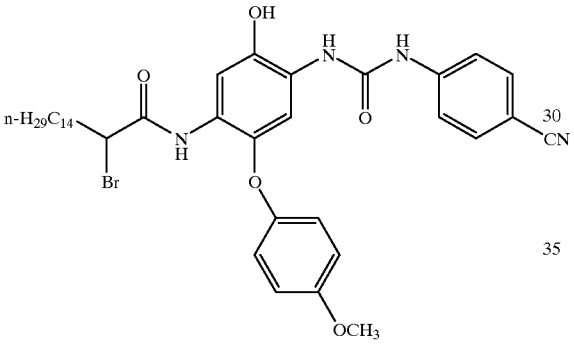
Comp-4
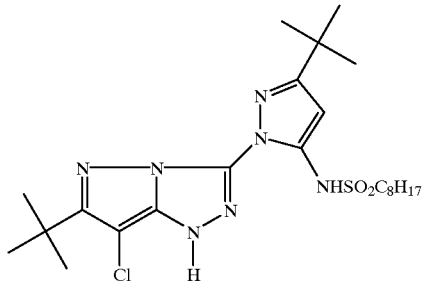
Comp-5
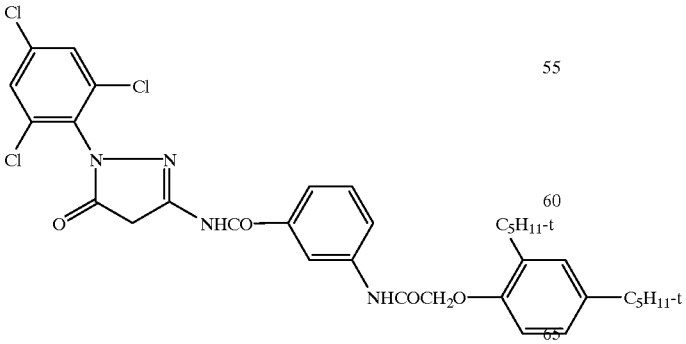

Conventional image couplers were as follows:

C-1

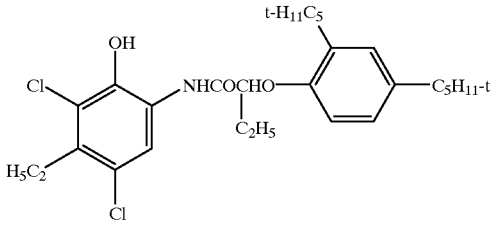

C-2

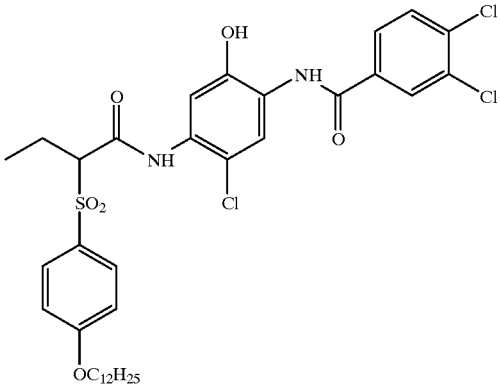

M-1

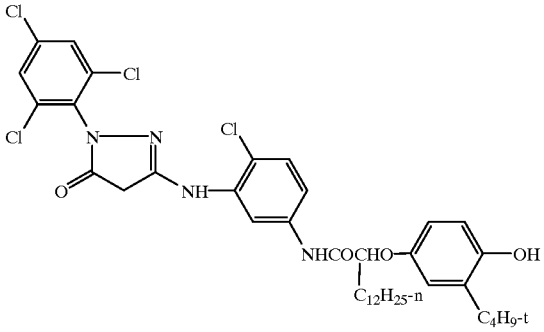

M-2

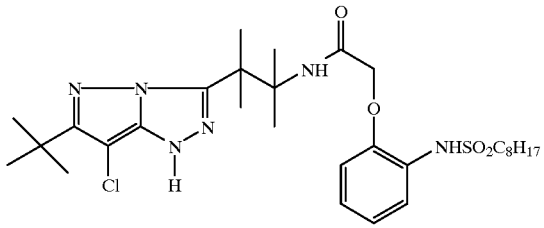

Y-3

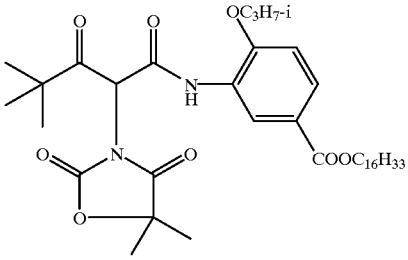

-continued

Y-5

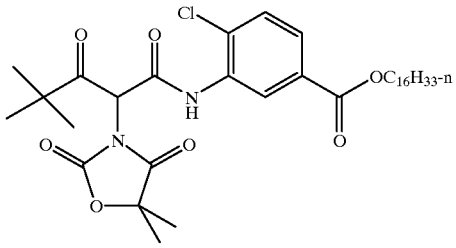

EXAMPLE 2

Single Layer Coating Containing a Red Sensitized Emulsion and Blue or Red Dye Forming Couplers Samples of blue and red dye forming couplers were dispersed using standard methods and coated in the same single layer format as their red counterparts illustrated in Table 5. After similarly exposing and processing, their characteristic dye spectra were determined and the λ-max values and hue-angles of each dye were calculated. The results of these characterizations are summarized in Tables 6a and 6b, below:

TABLE 6a

λ-Max and Hue-Angle of Red Dye Forming Couplers

| Coupler Type | Coupler | λ-max of Dye Vector @ 1.0 Density | Hue-angle |
|---|---|---|---|
| Inventive Red | IR-1 | 500 nm | 35 |
| " | IR-2 | 490 nm | 31 |
| " | IR-3 | 490 nm | 31 |
| " | IR-4 | 500 nm | 31 |
| " | IR-5 | 515 nm | 17 |
| " | IR-6 | 500 nm | 15 |
| " | IR-7 | 480 nm | 63 |
| " | IR-8 | 500 nm | 359 |
| " | IR-9 | 470 nm | 75 |

TABLE 6b

λ-Max and Hue-Angle of Blue Dye Forming Couplers

| Coupler Type | Coupler | λ-max of Dye Vector @ 1.0 Density | Hue-angle |
|---|---|---|---|
| Inventive Blue | IB-1 | 590 nm | 228 |
| " | IB-2 | 590 nm | 234 |
| " | IB-3 | 600 nm | 234 |
| " | IB-4 | 615 nm | 237 |
| " | IB-5 | 590 nm | 238 |
| " | IB-6 | 580 nm | 277 |

EXAMPLE 3

Multilayer Coating Containing Red Dye Forming Couplers

Silver chloride emulsions were chemically and spectrally sensitized as is described below.

Blue Sensitive Emulsion (Blue EM-2, prepared as described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ (136 μg/Ag-M) and $K_2IrCl_5$(5-methylthiazole) (72 μg/Ag-M), dopants were added during the silver halide grain formation for most of the precipitation. At 90% of the grain volume, precipitation was halted and a quantity of potassium iodide was added, equivalent to 0.2 M% of the total amount of silver. After addition, the precipitation was completed with the addition of additional silver nitrate and sodium chloride and subsequently followed by a shelling without dopant. The resultant emulsion contained cubic shaped grains of 0.60 μm in edge length. This emulsion was optimally sensitized by the addition of a colloidal suspension of aurous sulfide (18.4 mg/Ag-M) and heat ramped up to 60° C. during which time blue sensitizing dye BSD-4, (388 mg/Ag-M), 1-(3-acetamidophenyl)-5-mercaptotetrazole (93 mg/Ag-M) and potassium bromide (0.5 M%) were added. In addition, iridium dopant $K_2IrCl_6$ (7.4 μg/Ag-M) was added during the sensitization process.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ (1.36 μg/Ag-M) dopant and $K_2IrCl_5$(5-methylthiazole) (0.54 mg/Ag-M) dopant was added during the silver halide grain formation for most of the precipitation, followed by a shelling without dopant. The resultant emulsion contained cubic shaped grains of 0.30 μm in edge length. This emulsion was optimally sensitized by addition of a colloidal suspension of aurous sulfide (12.3 mg/Ag-M), heat digestion, followed by the addition of silver bromide (0.8 M%), green sensitizing dye, GSD-1 (427 mg/Ag-M), and 1-(3-acetamidophenyl)-5-mercaptotetrazole (96 mg/Ag-M).

Infrared Sensitive Emulsion (FS EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant (at 16.5 mg/Ag-M) and $K_2IrCl_5$(5-methylthiazole) dopant (at 0.99 mg/Ag-M) was added during the precipitation process. This emulsion was optimally sensitized by the addition of a colloidal suspension of aurous sulfide (60. mg/Ag-M) followed by a heat ramp to 65° C. for 45 minutes, followed by further additions of antifoggant, 1-(3-acetamidophenyl)-5-mercaptotetrazole (295. mg/Ag-M), iridium dopant ($K_2IrCl_6$ at 149. μg/Ag-M), potassium bromide (0.5 Ag-M%), DYE-5 (300 mg/Ag-M), infrared sensitizing dye IRSD-1 (33.0 mg/Ag-M) and finally, after the emulsion was cooled to 40° C., DYE-4 (10.76 mg/$M^2$).

Infrared Sensitive Emulsion (FS EM-2): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant (at 16.5 mg/Ag-M) and $K_2IrCl_5$(5-methylthiazole) dopant (at 0.99 mg/Ag-M) was added during the precipitation process. This emulsion was optimally sensitized by the addition of a colloidal suspension of aurous sulfide (60. mg/Ag-M) followed by a heat ramp to 65° C. for 45 minutes, followed by further additions of antifoggant, 1-(3-acetamidophenyl)-5-mercaptotetrazole (295. mg/Ag-M), iridium dopant $K_2IrCl_6$ (149. μg/Ag-M), potassium bromide (0.5 Ag-M%), DYE-5 (300 mg/Ag-M), infrared sensitizing dye IRSD-2 (33.0 mg/Ag-M) and finally, after the emulsion was cooled to 40° C., DYE-4 (10.76 mg/$M^2$).

Infrared and blue Sensitive Emulsion (FS EM-3): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant (16.5 mg/Ag-M) and $K_2IrCl_5$ (5-methylthiazole) dopant (0.99 mg/Ag-M) was added during the precipitation process. This emulsion was optimally sensitized by the addition of a colloidal suspension of aurous sulfide (60. mg/Ag-M) followed by a heat ramp to 65° C. for 45 minutes, followed by further additions of antifoggant, 1-(3-acetamidophenyl)-5-mercaptotetrazole (295. mg/Ag-M), iridium dopant $K_2IrCl_6$ (149. μg/Ag-M), potassium bromide (0.5 Ag-M%), DYE-5 (300 mg/Ag-M), infrared sensitizing dye IRSD-3 (33.0 mg/Ag-M) and finally, after the emulsion was cooled to 40° C., DYE-4 (10.76 mg/$M^2$).

Infrared Sensitive Emulsion (FS EM-4): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant (at 16.5 mg/Ag-M) and $K_2IrCl_5$(5-methylthiazole) dopant (0.99 mg/Ag-M) was added during the precipitation process. This emulsion was optimally sensitized by the addition of a colloidal suspension of aurous sulfide (60. mg/Ag-M) followed by a heat ramp to 65° C. for 45 minutes, followed by further additions of antifoggant, 1-(3-acetamidophenyl)-5-mercaptotetrazole (295. mg/Ag-M), iridium dopant $K_2IrCl_6$ (149. μg/Ag-M), potassium bromide (0.5 Ag-M%), DYE-5 (300 mg/Ag-M), infrared sensitizing dye IRSD-4 (33.0 mg/Ag-M) and finally, after the emulsion was cooled to 40° C., DYE-4 (10.76 mg/$M^2$).

Table 7, illustrates a conventional layer order for color negative papers such as Kodak Ektacolor Paper™. Inclusion of a $4^{th}$ sensitized layer requires the addition of adjacent interlayers to scavenge oxidized developer which may migrate from the $4^{th}$ sensitized layer to an adjacent imaging layer or, conversely, from an adjacent imaging layer to the $4^{th}$ sensitized layer. A coating structure for this composition is illustrated in Table 8. The composition of the individual layers for either structure is given in Table 9.

TABLE 7

| Conventional Coating Structure |
|---|
| Overcoat |
| UV absorbing layer |
| Red light sensitive layer |
| Interlayer |
| Green light sensitive layer |
| Interlayer |
| Blue light sensitive layer |
| Support |

TABLE 8

| Improved Coating Structure #1 |
|---|
| Overcoat |
| UV absorbing layer |
| Red light sensitive layer |
| Interlayer |
| Green light sensitive layer |
| Interlayer |

TABLE 8-continued

| Improved Coating Structure #1 |
|---|
| Blue light sensitive layer |
| Interlayer |
| 4th Sensitized Layer containing a Red or Blue Dye-forming Coupler |
| Support |

TABLE 9

| Composition of the Photographic Elements | g/M$^2$ |
|---|---|
| OC: Simultaneous Overcoat | |
| Gelatin | 0.645 |
| Dow Corning DC200 | 0.0202 |
| Ludox AM | 0.1614 |
| Di-t-octyl hydroquinone | 0.013 |
| Dibutyl phthalate | 0.039 |
| SF-1 | 0.009 |
| SF-2 | 0.004 |
| UV: UV light Absorbing Layer | |
| Gelatin | 0.624 |
| Tinuvin 328 | 0.156 |
| Tinuvin 326 | 0.027 |
| Di-t-octyl hydroquinone | 0.0485 |
| Cyclohexane dimethanol-bis-2-ethylhexanoic acid | 0.18 |
| Di-n-butyl phthalate | 0.18 |
| RL: Red Sensitive Layer | |
| Gelatin | |
| Red Sensitive Silver (Red EM-1) | 1.356 |
| C-1 or | 0.194 |
| C-2 | 0.381 |
| Dibutyl phthalate | 0.237 |
| UV-2 | 0.381 |
| 2-(2-butoxyethoxy)ethyl acetate | 0.245 |
| Di-t-octyl hydroquinone | 0.0312 |
| DYE-3 | 0.0035 |
| | 0.0665 |
| IR: 4th Sensitive Layer | |
| Gelatin | 1.076 |
| 4th Sensitive Silver (FS-EM-1, or 2, or 3, or 4) | 0.043 |
| 4th Coupler | varies |
| Di-n-butyl phthalate | 0.0258 |
| 2-(2-butoxyethoxy)ethyl acetate | 0.0129 |
| IL: Interlayer | |
| Gelatin | 0.753 |
| Di-t-octyl hydroquinone | 0.108 |
| Dibutyl phthalate | 0.308 |
| Di-sodium 4,5 Di-hydroxy-m-benzenedisulfonate | 0.0129 |
| SF-1 | 0.0495 |
| Irganox 1076 ™ | 0.0323 |
| | 0.462 |
| GL: Green Sensitive Layer | |
| Gelatin | 1.421 |
| Green Sensitive Silver | 0.0785 |
| M-1 or M-2 | 0.430 |
| Dibutyl phthalate | 0.237 |
| DUP | 0.0846 |
| ST-8 | 0.0362 |
| ST-21 | 0.181 |
| ST-22 | 0.064 |
| 1-Phenyl-5-mercaptotetrazole | 0.604 |
| DYE-2 | 0.0001 |
| | 0.0602 |
| BL: Blue Sensitive Layer | |
| Gelatin | 1.312 |
| Blue Sensitive Silver (Blue EM-2) | 0.227 |

TABLE 9-continued

| Composition of the Photographic Elements | g/M$^2$ |
|---|---|
| Y-3 or Y-5 | 0.414 |
| P-1 | 0.414 |
| Dibutyl phthalate | 0.414 |
| 1-Phenyl-5-mercaptotetrazole | 0.186 |
| DYE-1 | 0.0001 |
| | 0.009 |

Couplers C-1, M-1 and Y-5 or C-2, M-2 and Y-3 were coated as the cyan, magenta and yellow imaging couplers in the red and blue, green and red and blue sensitive records, RL, GL and BL. The 4$^{th}$ sensitized layer, IR, was made sensitive to infrared light by the presence of the infrared sensitizing dyes IRSD-1, or 2, or 3, or 4 on emulsions FS-EM-1, or FS-EM-2, or FS-EM-3 or FS-EM-4 respectively. One of these emulsions were coated in combination with couplers R-3 to R-16 or P-12 to generate various multilayer combination examples. Depending upon the selection of the emulsion for the 4$^{th}$ sensitized layer, the element has one of the following spectral sensitivities as given in table 10. The selection of emulsion sensitization for the 4$^{th}$ record is not critical to the invention. The important criterion for the design of the system is that the spectral sensitization of the 4th element not overlaps the sensitization of any of the three imaging records.

Generally speaking, an approximately 40 nm difference between the peak sensitivities of the various spectral sensitizing dyes is sufficient, so that when combined with the inherent emulsion efficiencies, absorber dyes in the element and power output and wavelength of the exposing device, an adequate level of exposure can be achieved which is unique and distinct from the other sensitized records.

TABLE 10

| Spectral Sensitivities of the Photographic Element | | |
|---|---|---|
| Emulsion | Sensitizing Dye | Peak Spectral Sensitivity |
| Blue EM-2 | BSD-4 | 473 nm |
| Green EM-1 | GSD-1 | 550 nm |
| Red EM-1 | RSD-1 | 695 nm |
| FS-EM-1 | IRSD-1 | 765 nm |
| Or FS-EM-2 | IRSD-2 | 765 nm |
| Or FS-EM-3 | IRSD-3 | 810 nm |
| Or FS-EM-4 | IRSD-4 | 750 nm |

Once the coated paper samples described above had been prepared and blue, they were given a preliminary evaluation as follows:

The respective paper samples were exposed in a Kodak Model 1B sensitometer with a color temperature of 3000° K and filtered and blue with a Kodak Wratten™ 2C plus a Kodak Wratten™ 29 filter, or a Kodak Wratten™ 98 filter or a Kodak Wratten™ 99 filter or a Kodak Wratten™ 88A filter in combination with a Hoya HA-50 to obtain the characteristic exposures of the red and blue, green, red and blue and infrared and blue sensitive emulsions. Exposure time was adjusted to 0.1 seconds. The exposures were performed by contacting the paper samples with a neutral density step exposure tablet having an exposure range of 0 to 3 log-E.

The characteristic vectors of the various colored and blue samples were obtained as described in Example 1, then the color gamuts of the various multilayer samples were calculated as described in the specifications. The color gamut was determined using the methods as described in J. Photographic Science, 38, 163 (1990) and the results are given in Table 11. Color gamuts are obtained by the above calculation method, assuming the use of resin-coated photographic paper base material, no light scatter, a D5000 viewing illuminant, and a Dmax of 2.2. The optimal spectral regions hold true for any Dmin, any amount of flare, any Dmax and any viewing illuminant.

The results of these calculations are shown in Table 11 below for the multilayer samples that contain cyan, magenta and yellow couplers C-1, C-2, M-1, M-2, Y-5 and Y-3 as comparative examples 38 and 39.

TABLE 11

Color Gamut as a Function of the C, M, Y Coupler Set

| Example/Type | C, M, Y Coupler | 4th Coupler | $h_{ab}$ of Dye | Color Gamut | Gamut Change | Percent Change |
|---|---|---|---|---|---|---|
| 1-Check | C-1 | None | 212 | 46,982 | na | na |
| | M-1 | | 333 | | | |
| | Y-5 | | 86 | | | |
| 2-Check | C-2 | None | 210 | 56,052 | 9,070 | 19% |
| | M-2 | | 329 | | | |
| | Y-3 | | 94 | | | |

The data in table 11, show that it is possible to significantly increase the color gamut of a photographic system by selecting preferred C,M,Y coupler sets. It has not been possible to significantly increase the color gamut beyond that demonstrated by example 39 using preferred cyan, magenta and yellow dye forming couplers.

TABLE 12a

Color Gamut as a Function of the Hue-Angle of the Red 4th Dye

| Example/ Type | C, M, Y Coupler | 4th Red Coupler | $h_{ab}$ of Dye | Color Gamut | Gamut Change | Percent Change |
|---|---|---|---|---|---|---|
| 2-Check | C-2 | None | 210 | 56,052 | na | na |
| | M-2 | | 329 | | | |
| | Y-3 | | 94 | | | |
| 3-Comp | " | IR-1 | 35 | 66,151 | 10,099 | +18% |
| 4-Comp | " | IR-2 | 31 | 62,087 | 6,035 | +11% |
| 5-Comp | " | IR-3 | 31 | 62,913 | 6,861 | +12% |
| 6-Comp | " | IR-4 | 31 | 62,176 | 6,124 | +11% |
| 7-Comp | " | IR-5 | 17 | 66,795 | 10,743 | +19% |
| 8-Comp | " | IR-6 | 15 | 62,207 | 61,55 | +11% |
| 9-Comp | " | IR-7 | 63 | 64,388 | 8,336 | +15% |
| 10-Comp | " | IR-8 | 359 | 64,170 | 8,118 | +14% |
| 11-Comp | " | IR-9 | 75 | 63,451 | 7,399 | +13% |
| 12-Comp | " | CR-1 | 344 | 60,820 | 4,768 | +9% |
| 13-Comp | " | CR-2 | 321 | 60,534 | 4,482 | +8% |
| 14-Comp | " | CR-3 | 329 | 59,747 | 3,695 | +7% |
| 15-Comp | " | CR-4 | 315 | 59,103 | 3,051 | +5% |
| 16-Comp | " | CR-5 | 84 | 59,378 | 3,326 | +6% |

As shown in the table 12 above, the color gamut of the comparative examples can be increased by adding a $4^{th}$ dye, to complement the cyan, magenta and yellow dyes already present in the multilayer element. When the hue-angle of the $4^{th}$ dye is greater than about 75°, but less than about 355°, as shown by the comparative examples, the improvement in gamut is small and less than 10%. When the hue-angle of the $4^{th}$ dye is within the desired range, the improvement in gamut is more than 10%.

The improvement in color gamut is not related to the specific chemical constitution of the chromophore of the $4^{th}$ colorant, but rather the hue-angle produced by the $4^{th}$ colorant, which is an optical property of the dye and depends solely upon the characteristic shape of the absorption band of the dye.

TABLE 12b

Color Gamut as a Function of the Hue-Angle of the Red 4th Dye

| Example/ Type | C, M, Y Coupler | 4th Coupler | $h_{ab}$ of Dye | Color Gamut | Gamut Change | Percent Change |
|---|---|---|---|---|---|---|
| 1-Check | C-1 | None | 212 | 46,982 | na | na |
| | M-1 | | 333 | | | |
| | Y-5 | | 86 | | | |
| 17-Comp | " | IR-1 | 35 | 53,639 | 6,657 | +14% |
| 18-Comp | " | IR-2 | 31 | 50,796 | 3,814 | +8% |
| 19-Comp | " | IR-3 | 31 | 51,318 | 4,336 | +9% |
| 20-Comp | " | IR-4 | 31 | 50,311 | 3,329 | +7% |
| 21-Comp | " | IR-5 | 17 | 54,461 | 7,479 | +16% |
| 22-Comp | " | IR-6 | 15 | 53,918 | 6,931 | +15% |
| 23-Comp | " | IR-7 | 63 | 52,693 | 5,711 | +12% |
| 24-Comp | " | IR-8 | 359 | 51,791 | 4,809 | +10% |
| 25-Comp | " | IR-9 | 75 | 53,367 | 6,385 | +14% |
| 26-Comp | " | CR-1 | 344 | 52,277 | 5,295 | +11% |
| 27-Comp | " | CR-2 | 321 | 50,731 | 3,749 | +8% |
| 28-Comp | " | CR-3 | 329 | 52,254 | 5,272 | +11% |
| 29-Comp | " | CR-4 | 315 | 51,598 | 4,616 | +10% |
| 30-Comp | " | CR-5 | 84 | 47,929 | 947 | +2% |

EXAMPLE 4

Multilayer Coating Containing Blue Dye Forming Couplers

Silver chloride emulsions were chemically and spectrally sensitized as were used in example 3.

TABLE 13

Color Gamut as a Function of the Hue-Angle of the Blue 4th Dye

| Example/ Type | C, M, Y Coupler | 4th Blue Coupler | $h_{ab}$ of Dye | Color Gamut | Gamut Change | Percent Change |
|---|---|---|---|---|---|---|
| 1-Check | C-1 | None | 212 | 46,982 | na | na |
| | M-1 | | 333 | | | |
| | Y-5 | | 86 | | | |
| 31-Comp | " | IB-1 | 228 | 54,986 | 8,004 | +17% |
| 32-Comp | " | IB-2 | 234 | 56,826 | 9,844 | +21% |
| 33-Comp | " | IB-3 | 234 | 56,791 | 9,809 | +21% |
| 34-Comp | " | IB-4 | 237 | 58,126 | 11,144 | +24% |
| 35-Comp | " | IB-5 | 238 | 58,005 | 11,023 | +23% |
| 36-Comp | " | IB-6 | 277 | 57,267 | 10,285 | +22% |
| 37-Comp | Like 1 | CB-1 | 211 | 48,210 | 1,228 | +3% |
| 38-Comp | " | CB-2 | 210 | 49,263 | 2,281 | +5% |
| 39-Comp | " | CB-3 | 218 | 51,251 | 4,269 | +9% |
| 40-Comp | " | CB-4 | 315 | 51,598 | 4,616 | +10% |
| 41-Comp | " | CB-5 | 321 | 50,731 | 3,749 | +8% |

As shown in the table above, the color gamut can be increased by adding a $4^{th}$ dye, to complement the cyan, magenta and yellow dyes already present in the multilayer element. When the hue-angle of the $4^{th}$ dye is outside the desired range, the improvement in gamut is less than 10%.

TABLE 14

Color Gamut as a Function of the Hue-Angle of the Blue 4th Dye

| Example/ Type | C, M, Y Coupler | 4th Blue Coupler | $h_{ab}$ of Dye | Color Gamut | Gamut Change | Percent Change |
|---|---|---|---|---|---|---|
| 2-Check | C-2 | None | 210 | 56,052 | na | na |
| | M-2 | | 329 | | | |
| | Y-3 | | 94 | | | |
| 42-Comp | " | IB-1 | 228 | 61,958 | 5,906 | +11% |
| 43-Comp | " | IB-2 | 234 | 63,879 | 7,827 | +14% |
| 44-Comp | " | IB-3 | 234 | 62,129 | 6,077 | +11% |
| 45-Comp | " | IB-4 | 237 | 64,227 | 8,175 | +15% |
| 46-Comp | " | IB-5 | 238 | 64,075 | 8,023 | +14% |
| 47-Comp | " | IB-6 | 277 | 63,082 | 7,030 | +13% |
| 48-Comp | " | CB-1 | 211 | 57,417 | 1,365 | +2% |

TABLE 14-continued

Color Gamut as a Function of the Hue-Angle of the Blue 4th Dye

| Example/ Type | C, M, Y Coupler | 4th Blue Coupler | $h_{ab}$ of Dye | Color Gamut | Gamut Change | Percent Change |
|---|---|---|---|---|---|---|
| 49-Comp | " | CB-2 | 210 | 59,955 | 3,903 | +7% |
| 50-Comp | " | CB-3 | 218 | 58,087 | 2,035 | +4% |
| 51-Comp | " | CB-4 | 315 | 59,103 | 3,051 | +5% |
| 52-Comp | " | CB-5 | 321 | 60,534 | 4,482 | +8% |

As shown in the table 14, above, the color gamut can be increased by adding a $4^{th}$ dye, to complement the cyan, magenta and yellow dyes already present in the multilayer element. However, when the hue-angle of the $4^{th}$ dye is outside the desired range, the improvement in gamut is less than 10%.

EXAMPLE 5

Multilayer Coating Containing Blue or Red Dye Forming Couplers

Couplers C-1 or C-2, M-1 or M-2 and Y-3 or Y-5 were coated as the cyan, magenta and yellow imaging couplers. The $4^{th}$ sensitized layer, IR, was made sensitive to light in the spectral region between the red and green spectral sensitizing dyes by the presence of the sensitizing dye GSD-2, on emulsion Red-EM-2. This emulsion was combined with red or blue couplers to generate the various multilayer combinations of photographic examples. This element has the following spectral sensitivities as given in Table 15:

TABLE 15

Spectral Sensitivities of the Photographic Element

| Emulsion | Sensitizing Dye | Peak Spectral Sensitivity |
|---|---|---|
| Blue EM-2 | BSD-4 | 473 nm |
| Green EM-1 | GSD-1 | 550 nm |
| Red EM-1 | RSD-1 | 695 nm |
| Red EM-2 | GSD-2 | 625 nm |

Results of the analysis of the elements formed in this example were similar to those described in examples 4 and 5 as only the spectral sensitization of the FS layer of the element was altered.

EXAMPLE 6

Multilayer Coating Containing Blue or Red Dye Forming Couplers

Silver chloride emulsions were chemically and spectrally sensitized as is described below.

Blue Sensitive Emulsion (Blue EM-1, prepared as described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ (136 $\mu$g/Ag-M) and $K_2IrCl_5$(5-methylthiazole) (72 $\mu$g/Ag-M), dopants were added during the silver halide grain formation for most of the precipitation. At 90% of the grain volume, precipitation was halted and a quantity of potassium iodide was added, equivalent to 0.2 M% of the total amount of silver. After addition, the precipitation was completed with the addition of additional silver nitrate and sodium chloride and subsequently followed by a shelling without dopant. The resultant emulsion contained cubic shaped grains of 0.60 $\mu$m in edge length. This emulsion was optimally sensitized by the addition of a colloidal suspension of aurous sulfide (18.4 mg/Ag-M) and heat ramped up to 60° C. during which time blue sensitizing dye BSD-2, (414 mg/Ag-M), 1-(3-acetamidophenyl)-5-mercaptotetrazole (93 mg/Ag-M) and potassium bromide (0.5 M%) were added. In addition, iridium dopant $K_2IrCl_6$ (7.4 $\mu$g/Ag-M) was added during the sensitization process.

Couplers C-1 or C-2, M-1 or M-2 and Y-3 or Y-5 were coated as the cyan, magenta and yellow imaging couplers. The $4^{th}$ sensitized layer, IR, was made sensitive to light in the spectral region between the blue and green spectral sensitizing dyes by the presence of the blue sensitizing dye BSD-2, on emulsion Blue-EM-2. This emulsion was combined with various red and/or blue couplers to generate the various multilayer combinations of photographic examples. This element has the following spectral sensitivities as given in Table 16 below:

TABLE 16

Spectral Sensitivities of the Photographic Element

| Emulsion | Sensitizing Dye | Peak Spectral Sensitivity |
|---|---|---|
| Blue EM-2 | BSD-4 | 473 nm |
| Green EM-1 | GSD-1 | 550 nm |
| Red EM-1 | RSD-1 | 695 nm |
| Blue EM-1 | BSD-2 | 425 nm |

In addition, the layer order of the element was altered and blue by moving the $4^{th}$ sensitized layer to the uppermost emulsion layer as shown in Table 17 below:

TABLE 17

| Comparative Structure #2 |
|---|
| Overcoat |
| UV absorbing layer |
| 4th Sensitized Layer containing a Red or Blue Dye forming Coupler |
| Interlayer |
| Red light sensitive layer |
| Interlayer |
| Green light sensitive layer |
| Interlayer |
| Blue light sensitive layer |
| Support |

The location of the $4^{th}$ sensitized layer in the multilayer structure is not critical to the practice of the invention. Placement of the layer in the middle or on the bottom is also possible.

Higher resolution images are obtained if the $4^{th}$ sensitized layer is placed as the top most sensitized record due to reduced light scattering as the emulsion is scan exposed. Inclusion of an antihalation layer as the undermost layer further improves the resolution of the system. Antihalation layers are well known in the photographic industry and are generally comprised of either finely divided silver metal particles (known as grey gel) or as mixtures of solid particle dye dispersions.

Results of the analysis of the elements formed in the example were similar to those described in example 4, 5, or 6 as only the spectral sensitization of the FS layer of the element was altered.

EXAMPLE 7

Multilayer Coating Containing Blue and Red Dye Forming Couplers

Example seven, demonstrates the color gamuts achieved when a $4^{th}$ sensitized record containing a red or blue dye forming coupler is combined with a $5^{th}$ sensitized record containing a blue or red sensitized coupler. Cyan dye forming couplers C-1 or C-2, magenta dye forming couplers M-1 or M-2 and yellow dye forming couplers Y-3 or Y-5 were combined with the red or blue dye forming couplers to complete the multilayer element structure.

The spectral sensitivities of the element are given in table 18, below:

TABLE 18

Spectral Sensitivities of the Photographic Element

| Record | Emulsion | Sensitizing Dye | Peak Spectral Sensitivity |
|---|---|---|---|
| Blue | Blue EM-2 | BSD-4 | 473 nm |
| Green | Green EM-1 | GSD-1 | 550 nm |
| Red | Red EM-1 | RSD-1 | 695 nm |
| $5^{th}$ Sensitive | Red EM-2 | GSD-2 | 625 nm |
| $4^{th}$ Sensitive | Blue EM-1 | BSD-2 | 425 nm |

Alternatively, the $4^{th}$ or $5^{th}$ sensitive layer could have been made sensitive in the infrared region, by using any of emulsions EM-IR-1 to 4 in place of emulsions Blue EM-1 or Red EM-2.

Combinations of red, blue and the base C,M,Y couplers were coated in the coating structure shown in table 19.

TABLE 19

| Inventive Structure |
|---|
| Overcoat |
| UV absorbing layer |
| $4^{th}$ Sensitized Layer containing a Red or Blue Dye forming Coupler |
| Interlayer |
| Red light sensitive layer |
| Interlayer |
| Green light sensitive layer |
| Interlayer |
| $5^{th}$ Sensitized Layer containing a Blue or Red Dye forming Coupler |
| Interlayer |
| Blue light sensitive layer |
| Support |

After the samples were prepared, they were exposed and processed using the same techniques as used in earlier examples. Samples of each of the elements were then characterized to determine the color gamut of the combined 5-colors formed by the cyan, magenta, yellow, red and blue dye forming couplers. The characteristic vectors of each dye were determined and the color gamut calculated. The results of this analysis are shown in table 20 below. In this example, the base cyan, magenta and yellow dye set was comprised of C-1, M-1 and Y-5. The additional red and blue dye forming couplers are given in the table. This set of couplers, C-1, M-1 and Y-5, produces a color gamut of 46,982.

The comparative examples show that the color gamut increase by adding a $4^{th}$ and $5^{th}$ colorant is limited to an overall increase less than about 20% where the desired hue angle is not present for both colorants. Comparative samples 57 and 58 have a combination of inventive and comparative couplers. In these instances, the achievable color gamut is further increased by about 30% and demonstrates the utility of these additional materials. However, the inventive combination examples demonstrate that the highest color gamuts are achieved. Inventive example 61 demonstrates an increase of more than 40% in color gamut over the base coupler set.

TABLE 20

Color Gamut of a 5 Color Photographic Print Element*+

| Example/ Type | Red Coupler | $h_{ab}$ | Blue Coupler | $h_{ab}$ | Color Gamut | Gamut Change* | % Change |
|---|---|---|---|---|---|---|---|
| 53-Comp | CR-5 | 84+ | CB-1 | 211+ | 52,068 | 5,086 | +11% |
| 54-Comp | CR-1 | 344+ | CB-3 | 218+ | 56,040 | 9,058 | +19% |
| 55-Comp | CR-1 | 344+ | CB-1 | 211+ | 53,704 | 6,722 | +14% |
| 56-Comp | CR-5 | 84+ | CB-3 | 218+ | 54,599 | 7,617 | +16% |
| 57-Comp | IR-5 | 17 | CB-3 | 217+ | 60,370 | 13,388 | +28% |
| 58-Comp | CR-5 | 84+ | IB-4 | 237 | 61,373 | 14,391 | +31% |
| 59-Comp | CR-5 | 84+ | IR-6 | 15+ | 52,189 | 5,207 | +11% |
| 60-Inv | IR-5 | 17 | IB-4 | 237 | 62,704 | 15,722 | +33% |
| 61-Inv | IR-1 | 35 | IB-5 | 238 | 66,476 | 19,494 | +41% |
| 62-Inv | IR-1 | 35 | IB-6 | 277 | 65,129 | 18,147 | +39% |
| 63-Inv | IR-7 | 63 | IB-2 | 234 | 63,460 | 16,478 | +35% |

*Base C, M, Y coupler set is C-1, M-1 and Y-5: Color Gamut is 46,982
+Denotes outside inventive range.

The data shown in Table 21 was obtained in a manner identical to that in Table 20. The examples shown in this table are, however, based upon the base coupler set which contains couplers C-2, M-2 and Y-3, which, due to their inherent spectral absorption's, produce an increase in color gamut over the base coupler set used in table 20. These couplers increase the color gamut by nearly 20% compared to C-1, M-1 and Y-5.

In addition, when combined with a $4^{th}$ and $5^{th}$ red and blue dye forming coupler are further capable of an increased color gamut. Comparative examples 86 to 89 illustrate that when the hue angle of the $4^{th}$ and $5^{th}$ couplers are not in the preferred ranges that the gamut of color is increased, but like those in table 20, only modestly so by about 15%. Further, comparative examples 91, 92 and 94 demonstrate that when only one of the two additional colorants are added, that a gamut increase is obtained and is improved over the examples where neither coupler is preferred. Combinations of these colorants provide an increase in gamut of up to 25%.

Inventive examples 90, 93, 95 and 96 show the truly surprising and significant increase in gamut when both the red and blue colorants have hue-angles which fall within the preferred ranges of the invention. In each of these examples, the increase in gamut is at least 30% compared to the base coupler set. In addition, inventive example 90 demonstrates a truly surprising increase in gamut, when compared to the base colorant set used in Table 20 of 65%.

TABLE 21

Color Gamut of a 5 Color Photographic Print Element*+

| Example/ Type | Red Coupler | $h_{ab}$ | Blue Coupler | $h_{ab}$ | Color Gamut | Gamut Change* | % Change |
|---|---|---|---|---|---|---|---|
| 64-Comp | CR-5 | 84+ | CB-1 | 211+ | 62,878 | 6,826 | +12% |
| 65-Comp | CR-1 | 344+ | CB-3 | 218+ | 65,055 | 9,003 | +16% |
| 66-Comp | CR-1 | 344+ | CB-1 | 211+ | 64,281 | 8,229 | +15% |
| 67-Comp | CR-5 | 84+ | CB-3 | 218+ | 62,878 | 6,826 | +12% |
| 68-Comp | IR-5 | 17 | CB-1 | 211+ | 70,247 | 14,195 | +25% |
| 69-Comp | CR-5 | 84 | IB-4 | 237 | 70,257 | 14,205 | +25% |
| 70-Comp | CR-5 | 84+ | IR-6 | 15+ | 64,295 | 8,243 | +15% |
| 71-Inv | IR-1 | 35 | IB-6 | 277 | 75,044 | 18,992 | +34% |
| 72-Inv | IR-5 | 17 | IB-4 | 237 | 77,518 | 21,466 | +38% |
| 73-Inv | IR-1 | 35 | IB-5 | 238 | 76,879 | 20,827 | +37% |
| 74-Inv | IR-7 | 63 | IB-2 | 234 | 73,196 | 17,144 | +31% |

*Base C, M, Y coupler set is C-2, M-2 and Y-3: Color Gamut is 56,052
+Denotes outside range of the invention.

Chemical Structures for Multilayer

BSD-2

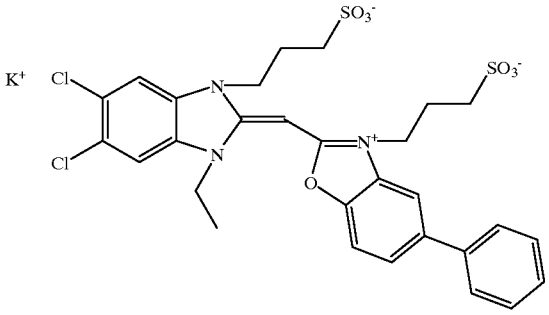

BSD-4

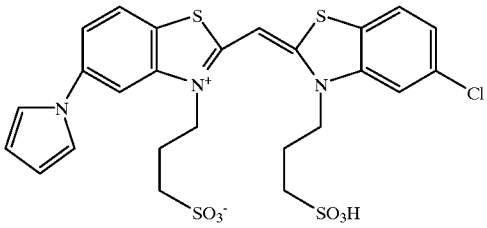

DYE-1

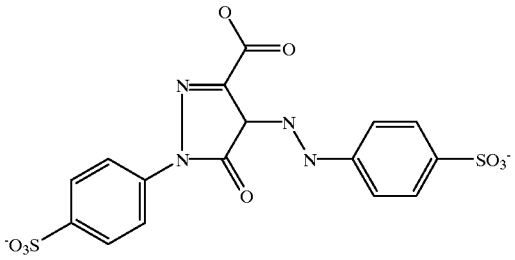

DYE-2

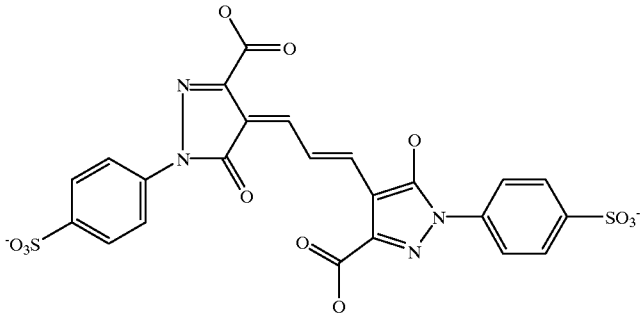

-continued
DYE-3
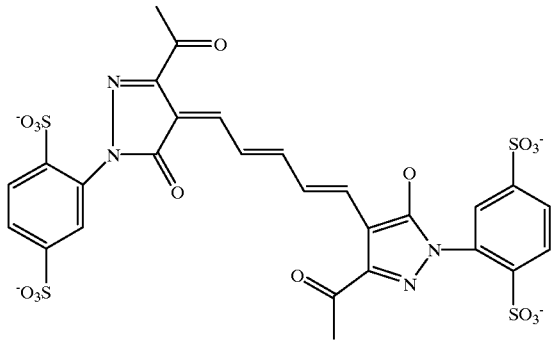
DYE-4
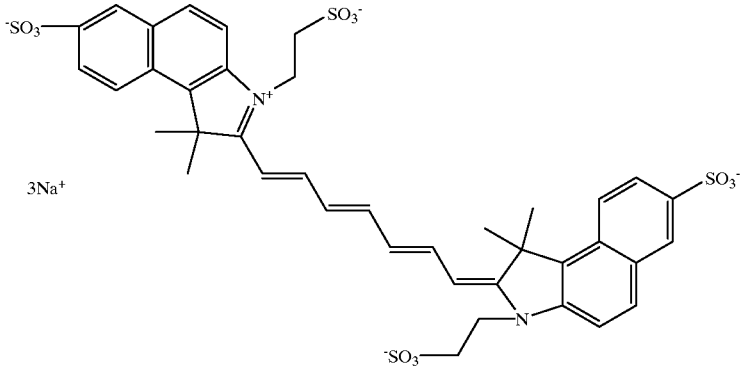
DYE-5
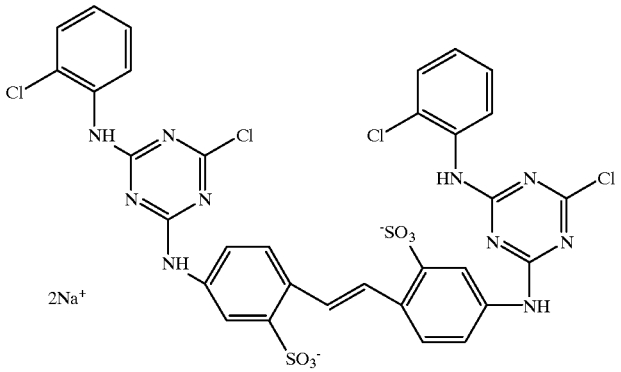
GSD-1
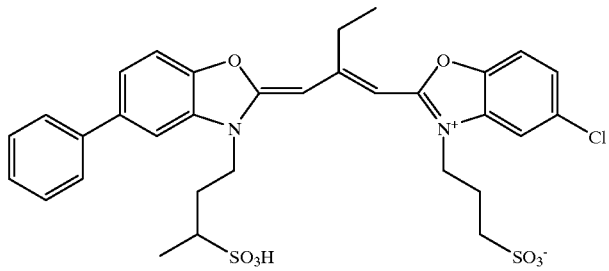

-continued
GSD-2
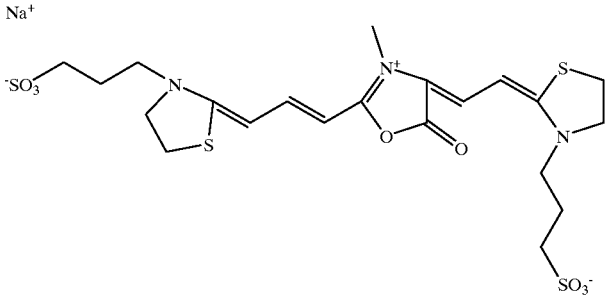
IRSD-1
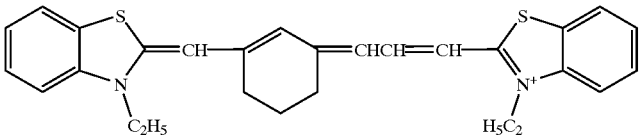
IRSD-2
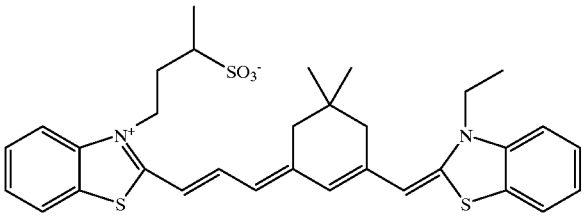
IRSD-3
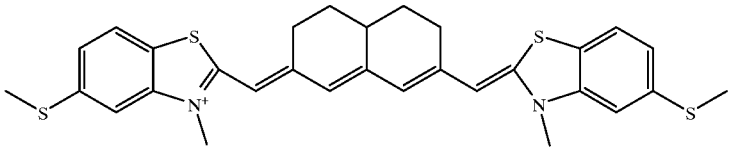
$F_3CSO_3^-$
IRSD-4
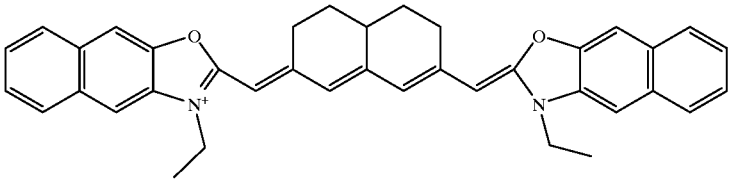
$F_3CSO_3^-$
RSD-1
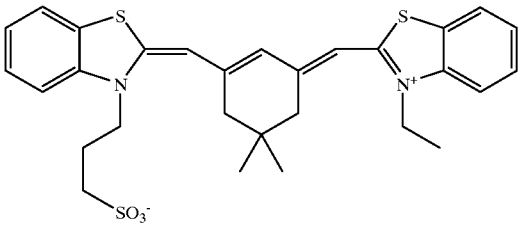
ST-6
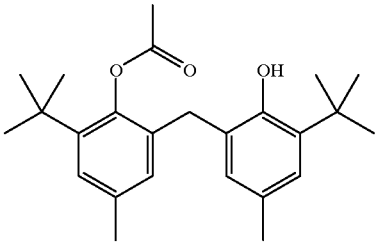
ST-8
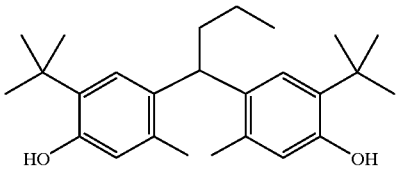
ST-16
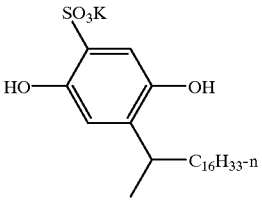

-continued

ST-21

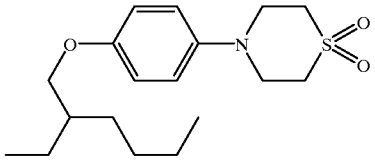

ST-22

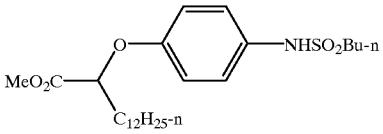

SF-1

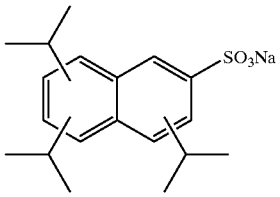

SF-2

$CF_3(CF_2)_7SO_3Na$

SF-12

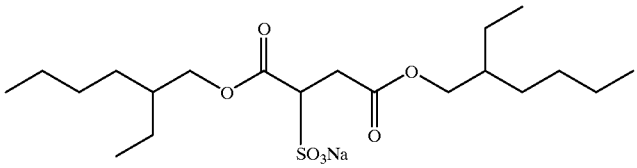

UV-1

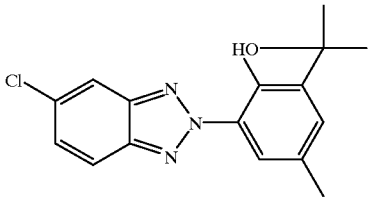

UV-2

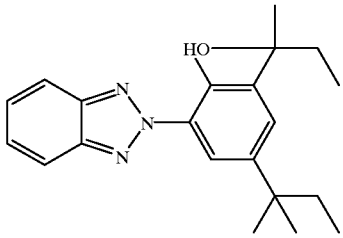

The invention has been described in detail with particular reference to the preferred and blue embodiments thereof, but it will be understood that variations and modifications can be effected within the spirit and scope of the invention.

What is claimed is:

1. A color photographic element comprising at least five imaging layers including:

a first light sensitive silver halide imaging layer having associated therewith a cyan image dye-forming coupler;

a second light sensitive silver halide imaging layer having associated therewith a magenta image dye-forming coupler;

a third light sensitive silver halide imaging layer having associated therewith a yellow image dye-forming coupler; and a fourth light sensitive silver halide imaging layer having associated therewith a fourth image dye-forming coupler for which the normalized spectral transmission density distribution curve of the dye formed by the fourth image dye-forming coupler upon reaction with color developer has a CIELAB hue angle, $h_{ab}$, from 225 to 310°; and a fifth light sensitive silver halide imaging layer having associated therewith a fifth image dye-forming coupler for which the normalized spectral transmission density distribution curve of the dye formed by the fifth image dye-forming coupler upon reaction with color developer has a CIELAB hue angle, $h_{ab}$, from not less than 355 to not more than 75°.

2. The element of claim 1 wherein the wavelength of maximum spectral sensitivity for the silver halide emulsions in the at least five imaging layers are separated by at least 30 nm.

3. The element of claim 1 wherein the hue angle of the dye formed by the fourth dye-forming coupler is from 228 to 305°.

4. The element of claim 1 wherein the hue angle of the dye formed by the fourth dye-forming coupler is from 230 to 290°.

5. The element of claim 1 wherein the hue angle of the dye formed by the fifth dye-forming coupler is from 5 to 75°.

6. The element of claim 1 wherein the hue angle of the dye formed by the fifth dye-forming coupler is from 15 to 75°.

7. The element of claim 4 wherein the hue angle of the dye formed by the fourth dye-forming coupler is from 25 to 45°.

8. The element of claim 1 wherein the fourth or fifth light sensitive silver halide emulsion layer is located below all of the other light sensitive layers.

9. The element of claim 1 wherein the fourth light sensitive layer is located above all of the other light sensitive layers.

10. The element of claim 1 wherein the fourth or fifth light sensitive layer is located above one of the other light sensitive layers and below another of the other light sensitive layers.

11. The element of claim 1 wherein there is a non-light sensitive layer between the fourth or fifth light sensitive layer and any adjacent light sensitive layer.

12. The element of claim 2 wherein the fourth and fifth light sensitive layers have a maximum spectral sensitivity that is at least 30 nm away from the maximum spectral sensitivity of any of the other light sensitive layers.

13. The element of claim 1 wherein the fourth or fifth light sensitive layer has a maximum spectral sensitivity that is greater than 700 nm.

14. The element of claim 1 wherein the fourth or fifth light sensitive layer has a maximum spectral sensitivity that is greater than 720 nm.

15. The element of claim 1 wherein the fourth or fifth light sensitive layer has a maximum spectral sensitivity of from 590 to 640 nm.

16. The element of claim 1 wherein the fourth or fifth light sensitive layer has a maximum spectral sensitivity of from 400 to 460 nm.

17. The element of claim 1 wherein at least one of the fourth and fifth couplers is an azole, anilide, or phenolic coupler.

18. The element of claim 1 additionally comprising a reflective support.

19. The element of claim 1 additionally comprising a transparent support.

20. The element of claim 1 packaged with instructions to process using a color negative print developing process.

21. The element of claim 1 wherein the element is a direct-view element.

22. A process for forming an image in an element as described in claim 1 after the element has been imagewise exposed to light comprising contacting the element with a color-developing compound.

23. The process of claim 22 in which the developer is a p-phenylene diamine compound.

24. The element of claim 1 wherein the emulsions in the element are comprised of 3-dimensional silver chloride emulsions, which are predominantly greater than 95 M% silver chloride.

25. The element of claim 1 wherein the emulsions are predominantly monodisperse.

26. The element of claim 1 wherein the grain sizes of the emulsions are between 0.05 u and 0.95 u in cubic edge length.

27. The element of claim 1 wherein at least one of the emulsions of the element contains iridium.

28. The element of claim 1 wherein the emulsions are sulfur and gold sensitized.

* * * * *

UNITED STATES PATENT AND TRADEMARK OFFICE

CERTIFICATE OF CORRECTION

PATENT NO. : 6,180,328 B1
DATED : January 30, 2001
INVENTOR(S) : James L. Edwards, William J. Begley It is certified that error appears in the above-identified patent and that said Letters Patent is hereby corrected as shown below:

Column 71,
Line 44, insert -- separately sensitized -- after "at least five".

Column 74,
Line 16, delete "0.05 u and 0.95 u" and insert -- 0.05μ and 0.95μ --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*